US005861366A

United States Patent [19]

Ihns et al.

[11] Patent Number: 5,861,366

[45] Date of Patent: Jan. 19, 1999

[54] PROTEOLYTIC ENZYME CLEANER

[75] Inventors: Deborah A. Ihns, St. Paul; William Schmidt, Woodbury; Francis R. Richter, Circle Pines, all of Minn.

[73] Assignee: Ecolab Inc., St. Paul, Minn.

[21] Appl. No.: 650,963

[22] Filed: May 21, 1996

Related U.S. Application Data

[63] Continuation of Ser. No. 390,650, Feb. 16, 1995, abandoned, which is a continuation-in-part of Ser. No. 298,950, Aug. 31, 1994.

[51] Int. Cl.[6] ..... C11D 17/00

[52] U.S. Cl. ..... 510/320; 510/374; 510/392; 510/234; 510/446

[58] Field of Search ..... 510/320, 374, 510/392, 234, 446

[56] References Cited

U.S. PATENT DOCUMENTS

| | | | |
|---|---|---|---|
| 1,882,279 | 10/1932 | Frelinghuysen . | |
| 2,599,807 | 6/1952 | Bersworth | 260/500 |
| 2,674,619 | 4/1954 | Lundsted | 260/485 |
| 2,677,700 | 5/1954 | Jackson et al. | 260/488 |
| 2,903,486 | 9/1959 | Brown et al. | 260/613 |
| 3,048,548 | 8/1962 | Martin et al. | 252/135 |
| 3,213,030 | 10/1965 | Diehl | 252/152 |
| 3,308,067 | 3/1967 | Diehl | 252/161 |
| 3,382,178 | 5/1968 | Lissant et al. | 252/135 |
| 3,451,935 | 6/1969 | Roald et al. | 252/135 |
| 3,519,570 | 7/1970 | McCarty | 252/135 |
| 3,635,830 | 1/1972 | Lamberti et al. | 252/153 |
| 3,664,961 | 5/1972 | Norris | 252/99 |
| 3,697,451 | 10/1972 | Mausner et al. | 252/545 |
| 4,087,368 | 5/1978 | Borrello | 252/89 R |
| 4,144,226 | 3/1979 | Crutchfield et al. | 528/231 |
| 4,169,817 | 10/1979 | Weber | 252/545 |
| 4,212,761 | 7/1980 | Ciaccio | 510/234 |
| 4,238,345 | 12/1980 | Guilbert | 252/174.12 |
| 4,243,543 | 1/1981 | Guilbert | 252/105 |
| 4,315,092 | 2/1982 | Crutchfield et al. | 528/230 |
| 4,423,543 | 1/1984 | Guilbert et al. | 252/105 |
| 4,692,260 | 9/1987 | Sung et al. | 252/99 |
| 4,965,012 | 10/1990 | Olson | 252/174.12 |
| 5,064,553 | 11/1991 | Dixit et al. | 252/94 |
| 5,064,561 | 11/1991 | Rouillard | 252/174.12 |
| 5,133,892 | 7/1992 | Chun et al. | 510/320 |
| 5,312,624 | 5/1994 | Richter | 424/105 |
| 5,384,364 | 1/1995 | Besse et al. | 252/90 |
| 5,385,653 | 1/1995 | Gladfelter | 252/90 |
| 5,429,765 | 7/1995 | Flower | 510/320 |
| 5,466,594 | 11/1995 | Outtrup et al. | 510/320 |
| 5,643,777 | 7/1997 | Antranikian et al. | 510/320 |

FOREIGN PATENT DOCUMENTS

| | | |
|---|---|---|
| 283923 | 12/1913 | Germany . |
| 1026366 | 4/1966 | United Kingdom . |
| 8911753 | 11/1989 | WIPO . |

OTHER PUBLICATIONS

"Fouling of Milk Proteins and Salts—Reduction of Fouling by Technological Measures", *Fouling and Cleaning in Food Processing*, Institute for Dairy Science and Food Processing Technische Universitat Munchen, Federal Republic of Germany (1989), pp. 37–45.

"Effect of Added Hypochlorite on Detergent Activity of Alkaline Solutions in Recirculation Cleaning", *Jnl. of Milk & Food Technology*, MacGregor, D.R., Elliker, P.R. and Richardson, G.A., vol. 17, (1954) pp. 136–138.

"Futher Studies on In–Place Cleaning", *Journal of Dairy Science*, Kaufmann, O.W., Andrews, R.H. and Tracy, P.H. vol. 38, No. 4, (1955) pp. 371–379.

"Formation and Removal of an Iridescent Discoloration in Cleaned–In–Place Pipelines", *Journal of Dairy Science*, Kaufmann, O.W. and Tracy, P.H., vol. 42, (1959), pp. 1883–1885.

"Cleanability of Milk–Filmed Stainless Steel by Chlorinated–Detergent Solution", *Journal of Dairy Science*, Jensen, J.M., vol. 53, No. 2, (1970), pp. 248–251.

"Cleaning Chemicals—State of the Knowledge in 1985", *Fouling and Cleaning in Food Processing*, Department of Food Science University of Wisconsin–Madison, (1985) pp. 313–335.

"Forces in Detergency", Harris, J.C. *Soap and Chemical Specialties*, vol. 37 (8), Part VI, pp. 61–62, 104 and 106.

"Forces in Detergency", Harris, J.C. *Soap and Chemical Specialties*, Part V, pp. 61–64. Date Unknown.

"Physico–chemical aspects of hard–surface cleaning. 1. Soil removal mechanisms", Koopal, L.K., *Nethl. Milk Dairy J.*, 39, pp. 127–154 (1985).

Definition of the Word "Detergent", Bourne, M.C. and Jennings, W.G., *The Journal of the American Oil Chemists' Society*, 40, p. 212 (1963).

"Milk Components and Their Characteristics", Harper, W.J., in *Dairy Technology and Engineering*, The AVI Publishing Company, Westport (1976), pp. 18–19.

"Principles of Protein Adsorption", *Surface and Interfacial Aspects of Biomedical Polymers*, Andrade, J.D., vol. 2, Chapter 1, pp. 1–80, Plenum Press, New York (1985).

"Interactions of Macromolecules with Surfaces in Shear Fields Using Visible Wavelength Total Internal Reflection Fluorescence", *Surface and Interfacial Aspects of Biomedical Polymers*, Cheng, Y., Lok, B.K. and Robertson, C.R., vol. 2, Chapter 3, pp. 121–160. Date Unknown.

(List continued on next page.)

*Primary Examiner*—Sharon Gibson
*Assistant Examiner*—Cephia D. Toomer
*Attorney, Agent, or Firm*—Merchant, Gould, Smith, Edell, Welter, & Schmidt, P.A.

[57] ABSTRACT

Compositions for use as soil removing agents in the food processing industry are disclosed. Food soiled surfaces in food manufacturing and preparation areas can be cleaned. The compositions are preferably manufactured in the form of a solid block or powder concentrate which is diluted with water and used. The cleaning materials are made in a one or two part system which are diluted with a diluent source and mixed prior to use. The products contain high quality cleaning compositions and use a variety of active ingredients. The preferred materials, in a one or two part system, contain detergent compositions, enzymes that degrade food compositions, surfactants, low alkaline builders, water conditioning (softening) agents, and optionally a variety of formulary adjuvants depending on product form.

11 Claims, 2 Drawing Sheets

OTHER PUBLICATIONS

"Protein Adsorption Hysteresis", *Surface and Interfacial Aspects of Biomedical Polymers*, Jennissen, H.P., vol. 2, Chapter 9, pp. 295–320. Date Unknown.

"Modeling of Protein Adsorption", *Surface and Interfacial Aspects of Biomedical Polymers*, Silberberg, A., vol. 2, Chapter 10, pp. 321–337. Date Unknown.

"Protein Adsorption and Materials Biocompatibility: A Tutorial Review and Suggested Hypothesses", *Advances in Polymer Science*, Andrade, J.D. and Hlady, V., vol. 79, pp. 1–63, Springer–Verlag Berlin Heidelberg, (1986).

"Fouling of Heating Surfaces—Chemical Reaction Fouling Due to Milk", *Fouling and Cleaning in Food Processing*, Department of Food Science University of Wisconsin–Madison, (1985) pp. 122–167.

"Model Studies of Food Fouling", *Fouling and Cleaning in Food Processing* Institute for Dairy Science and Food Processing, Technische Universitat Munchen, Federal Republic of Germany (1989), pp. 1–13.

"Surfactant Encyclopedia", *Cosmetics & Toiletries*, vol. 104, Feb. 1989, pp. 67–112.

"The Use of Azoalbumin as a Substrate in the Colorimetric Determination of Peptic and Tryptic Activity", *J. Lab. Clin. Chem.*, Tomarelli, R.M. Charney, J., and Harding, M.L., 34 (1949), pp. 428–433.

"Industrial Enzymes", *Kirk–Othmer Encyclopedia of Chemical Technology*, Scott, D., 3rd Edition, vol. 9 (1980), pp. 138–148, 173–224.

"Forces in Detergency", Harris, J.C., *Soap and Chemical Specialties*, vol. 37 (5), Part I, pp. 68–71 and 125.

"Forces in Detergency", Harris, J.C., *Soap and Chemical Specialties*, vol. 37 (6), Part II, pp. 50–52.

"Forces in Detergency", Harris, J.C., *Soap and Chemical Specialties*, vol. 37 (7), Part III, pp. 53–55.

"Germicidal and Detergent Sanitizing Action of Disinfectants", *Official Methods of Analysis of the Association of Official Analytical Chemists*, paragraph 960.09 and application sections, 15th Edition, 1990 (EPA Guidelines 91–2).

"Sanitizer Test (for inanimate, non–food contact surfaces)", Efficacy Data Requirements of EPA DIS/TSS–10, 07 Jan. 1982.

"Theory and Practice of Hard–Surface Cleaning", Jennings, W.G., *Advances in Food Research*, vol. 14, pp. 325–455 (1965).

PROTEOLYTIC ENZYME CLEANER

CROSS-REFERENCE TO RELATED APPLICATION

This is a file wrapper continuation of application Ser. No. 08/390,650, filed Feb. 16, 1995, now abandoned, which is a CIP of Ser. No. 08/298,950, filed Aug. 31, 1994, pending.

FIELD OF THE INVENTION

The invention relates to enzyme containing detergent compositions that can be used to remove food soil from typically food or foodstuff related manufacturing equipment or processing surfaces. The invention relates to enzyme containing formulations in a one and two part aqueous composition, a non-aqueous liquids composition, a cast solid, a granular form, a particulate form, a compressed tablet, a gel, a paste and a slurry form. The invention also relates to methods capable of a rapid removal of gross food soils, films of food residue and other minor food or proteinaceous soil compositions.

BACKGROUND OF THE INVENTION

Periodic cleaning and sanitizing in the food process industry is a regimen mandated by law and rigorously practiced to maintain the exceptionally high standards of food hygiene and shelf-life expected by today's consumer. Residual food soil, left on food contact equipment surfaces for prolonged periods, can harbor and nourish growth of opportunistic pathogen and food spoilage microorganisms that can contaminate foodstuffs processed in close proximity to the residual soil. Insuring protection of the consumer, against potential health hazards associated with food borne pathogens and toxins and, maintaining the flavor, nutritional value and quality of the foodstuff, requires diligent cleaning and soil removal from any surfaces of which contact the food product directly or are associated with the processing environment.

The term "cleaning", in the context of the care and maintenance of food preparation surfaces and equipment, refers to the treatment given all food product contact surfaces following each period of operation to substantially remove food soil residues including any residue that can harbor or nourish any harmful microorganism. Freedom from such residues, however, does not indicate perfectly clean equipment. Large populations of microorganisms may exist on food process surfaces even after visually successful cleaning. The concept of cleanliness as applied in the food process plant is a continuum wherein absolute cleanliness is the ideal goal always strived for; but, in practice, the cleanliness achieved is of lesser degree.

The term "sanitizing" refers to an antimicrobicidal treatment applied to all surfaces after the cleaning is effected that reduces the microbial population to safe levels. The critical objective of a cleaning and sanitizing treatment program, in any food process industry, is the reduction of microorganism populations on targeted surfaces to safe levels as established by public health ordinances or proven acceptable by practice. This effect is termed a "sanitized surface" or "sanitization". A sanitized surface is, by Environmental Protection Agency (EPA) regulation, a consequence of both an initial cleaning treatment followed with a sanitizing treatment. A sanitizing treatment applied to a cleaned food contact surface must result in a reduction in population of at least 99.999% reduction (5 log order reduction) for a given microorganism. Sanitizing treatment is defined by "Germicidal and Detergent Sanitizing Action of Disinfectants", *Official Methods of Analysis of the Association of Official Analytical Chemists*, paragraph 960.09 and applicable sections, 15th Edition, 1990 (EPA Guideline 91-2). Sanitizing treatments applied to non-food contact surfaces in a food process facility must cause 99.9% reduction (3 log order reduction) for given microorganisms as defined by the "Non-Food Contact Sanitizer Method, Sanitizer Test" (for inanimate, non-food contact surfaces), created from EPA DIS/TSS-10, 07 Jan. 1982. Although it is beyond the scope of this invention to discuss the chemistry of sanitizing treatments, the microbiological efficacy of these treatments is significantly reduced if the surface is not clean prior to sanitizing. The presence of residual food soil can inhibit sanitizing treatments by acting as a physical barrier which shields microorganisms lying within the soil layer from the microbicide or by inactivating sanitizing treatments by direct chemical interaction which deactivates the killing mechanism of the microbicide. Thus, the more perishable the food, the more effective the cleaning treatment must be.

The technology of cleaning in the food process industry has traditionally been empirical. The need for cleaning treatments existed before a fundamental understanding of soil deposition and removal mechanism was developed. Because of food quality and public health pressures, the food processing industry has attained a high standard of practical cleanliness and sanitation. This has not been achieved without great expense, and there is considerable interest in more efficient and less costly technology. As knowledge about soils, the function of cleaning chemicals, and the effects of cleaning procedures increased and, as improvements in plant design and food processing equipment become evident, the cost effectiveness and capability of cleaning treatments, i.e. cleaning products and procedures, to remove final traces of residue have methodically improved. The consequence for the food process industry and for the public is progressively higher standards.

The search for ever more efficient and cost effective cleaning treatments, coupled with increasing demand for user friendly and environmentally compatible cleaning chemicals, has fostered a growing number of investigations which have significantly augmented understanding of soil deposition and removal processes by theoretical treatise rather than empirical experimentation. See, for example, "Theory and Practice of Hard-Surface Cleaning", Jennings, W. G., *Advances in Food Research*, Vol. 14, pp. 325–455 (1965); or, "Forces in Detergency", Harris, J. C., *Soap and Chemical Specialties*, Vol. 37 (5), Part I, pp. 68–71 and 125; Vol. 37 (6), Part II, pp. 50–52; Vol. 37 (7), Part III, pp. 53–55; Vol. 37 (8), Part IV, pp. 61–62, 104, 106; Part V, pp. 61–64; (1961) or "Physico-chemical aspects of hard-surface cleaning. 1. Soil removal mechanisms", Koopal, L. K., *Neth. Milk Dairy J.*, 39, pp. 127–154 (1985). Such studies confirm that soil deposition on a surface and the sequential transitions of soil adherence to the surface (adsorption), soil removal from the surface and soil suspension in a cleaning/solution, can be described in terms of well established, generally accepted concepts of colloidal and surface chemistry. The significance of this association is that predictive tools now exist which assist the design of chemical cleaning compounds optimized for specific soils or formulated to overcome other deficiencies in the cleaning program.

These precepts suggest that a clean surface is difficult to maintain, that energy is released (entropy is increased) during soil deposition which favors physicochemical stability, i.e. a soiled surface is nature's preferred or more stable condition. To reverse this process and clean the surface, energy must necessarily be supplied. In normal practice, this energy takes the form of mechanical and thermal energies carried to the soiled surface. Chemical (detergent) additives to the cleaning solution (usually water) reduce the amount of energy required to reverse the energetically favored soiling process. Thus, the definition of detergent (Definition of the Word "Detergent", Bourne, M. C. and Jennings, W. G., *The Journal of the American Oil Chemists' Society*, 40, p. 212 (1963)) is "any substance that either alone or in a mixture reduces the work requirement of a cleaning process". Simply, detergents are used because they make cleaning easier. It follows that the word "detergency" is "then understood to mean cleaning or removal of soil from a substrate by a liquid medium." (Ibid.)

Soil removal cannot be considered a spontaneous process because soil removal kinetics require a finite period. The longer the cleaning solution is in contact with the deposited soil, the more soil is removed—to a practical limit. Final traces of soil become increasingly difficult to remove. In the last phase of the soil removal process, cleaning involves overcoming the very strong adhesive force between soil and substrate surface, rather than the weaker cohesive soil—soil forces; and, an equilibrium state is eventually attained when soil redeposition occurs at the same rate as soil removal. Thus the major operational parameters of a cleaning treatment in a food process facility are mechanical work level, solution temperature, detergent composition and concentration, and contact time. Of course other variables such as equipment surface characteristics; soil composition, concentration, and condition; and water composition effect the cleaning treatment. However, these factors cannot be controlled and consequently must be compensated for as required.

The food process industry has come to rely more on detergent efficiency to compensate for design or operational deficiencies in their cleaning programs. This is not to suggest that the industry has not addressed these factors; indeed, cleaning processes have changed considerably during recent years because of technological advances in food processing equipment and development of specialized cleaning equipment. Modern food processing industries have revolutionized their clean-up procedures through cleaning-in-place (CIP) and automation.

A major challenge of detergent development for the food process industry in the successful removal of soils that are resistant to conventional treatment and the elimination of chemicals that are not compatible with food processing. One such soil is protein, and one such chemical is chlorine or chlorine yielding compounds, which can be incorporated into detergent compounds or added separately to cleaning programs for protein removal.

Protein soil residues, often called protein films, occur in all food processing industries but the problem is greatest for the dairy industry, milk and milk products producers because these are among the most perishable of major foodstuffs and any soil residues have serious quality consequences. That protein soil residues are common in the fluid milk and milk by-products industry, including dairy farms, is no surprise because protein constitutes approximately 27% of natural milk solids, ("Milk Components and Their Characteristics", Harper, W. J., in Diary *Technology and Engineering* (editors Harper, W. J. and Hall, C. W.) p. 18–19, The AVI Publishing Company, Westport, 1976).

Proteins are biomolecules which occur in the cells, tissues and biological fluids of all living organisms, range in molecular weight from about 6000 (single protein chain) to several millions (protein chain complexes); and, can simplistically be described as polyamides composed of covalently linked alpha amino acids (i.e., the —$NH_2$ group is attached to the carbon next to the —COOH group) of the general structure (L-configuration):

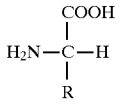

where R represents a functional group specific for each alpha amino acid. Of over 100 naturally occurring amino acids, only 20 are utilized in protein biosynthesis—their number and sequential order characterizing each protein. The covalent bond that joins amino acids together in proteins is called a peptide bond and is formed by reaction between the alpha —$NH_3^+$ group of one amino acid and the alpha —$COO^-$ group of another (reactions occur in solution; and, alpha —$NH_2$ groups and alpha —COOH groups are ionized at physiological pH with the protonated amino group bearing a positive charge and the deprotonated carboxyl group a negative charge) as illustrated for a dipeptide:

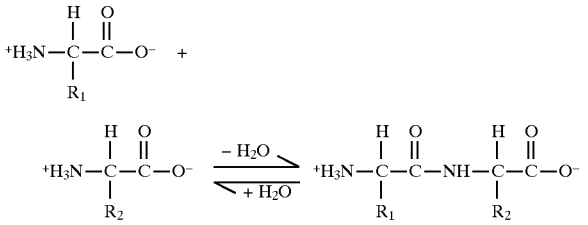

wherein $R_1$ and $R_2$ represent characteristic amino acid groups. Molecules composed of many sequential peptide bonds are called polypeptides; and, one or more polypeptide chains are contained in molecular structures of proteins.

Polypeptides alone do not make a biologically functional protein. A unique conformation or three-dimensional structure also must exist, which is determined by interactions between a polypeptide and its aqueous environment, and driven by such fundamental forces as ionic or electrostatic interactions; hydrophobic interactions; hydrogen and covalent bonding; and change transfer interactions. The complex three-dimensional structure of the protein macromolecule is that conformation which maximizes stability and minimizes the necessary energy to maintain. In fact, four levels of structure influence a protein's structure; three being intramolecular and existing in single polypeptide chains, and the fourth being intermolecular associations within a multi-chained molecule. Principles of protein structure are available in modern biochemistry textbooks, for example: *Biochemistry*, Armstrong, F. B., 3rd edition, Oxford University Press, New York, 1989; or *Physical Biochemistry*, Freifelder, D., 2nd edition, W. H. Eruman Company, San Francisco, 1982; or *Principles of Protein Structure*, Schultz, G. E. and Schumer, R. H., Springer-Verlag, Berlin, 1979.

Protein interactions with surfaces have been studied for decades, with early focus on blood-plasma-serum applications and more recent emphasis in the so-called biocompatibility-biomaterials field or medical device implants. This work characterized the solid surface-protein solution interface and developed a range of new concepts and new experimental tools for research. Two comprehensive reviews of this literature are: "Principles of Protein Adsorption", in *Surface and Interfacial Aspects of Biomedical Polymers*, Andrade, J. D., (editor Andrade, J. D.), Vol. 2, pp. 1–80, Plenum Press, New York, 1985; and "Protein Adsorption and Materials Biocompatibility: A Tutorial Review and Suggested Hypotheses", Andrade, J. D. and Hlady, V., *Advances in Polymer Science*, Vol. 79, pp. 1–63, Springer-Verlag Berlin Heidelberg, 1986.

A growing source of protein adsorption information is now in literature, specifically dealing with soils. Studies have established that the same intrinsic interactions and associations within the protein molecule responsible for three-dimensional structure also attract and bind proteins to surfaces. Because of their size and complex structure, proteins contain heterogeneous modules consisting of electrically charged (both negative and positive) regions, hydrophobic regions, and hydrophilic polar regions, analogous in character to similar areas on food processing equipment surfaces having trace soil residues. The protein can thus interact with the hard surface in a variety of different ways, depending on the particular orientation exposed to the surface, the number of binding sites, and overall binding energies.

Because biological fluids such as milk are complex mixtures, the kinetics of the protein adsorption process are confused by concurrent events occurring at interfacial surfaces within the bulk solution and at the equipment surfaces. Temperature, pH, protein populations and concentrations, and presence of other inorganic and organic moieties have effect on rate dynamics. In general, however, there is general agreement that protein adsorption is rapid, reversible, and randomly arranged at fractional surface covering less than 50%; and, the rate is mass transport controlled, i.e. all adsorption and desorption processes depend on transport of bulk solute to and from the interface. As coverage exceeds 50%, surface ordering develops, and given sufficient contact time, adsorbed proteins undergo conformational and orientational changes to optimize interfacial interactions and system stability. Proteins less optimally adsorbed undergo desorption or exchange by larger proteins having more binding sites. The process rate becomes surface reaction limited (mass action controlled). With increasing residence time, protein adsorption becomes irreversible.

Several representative articles describing food soil deposition studies are: "Fouling of Heating Surfaces-Chemical Reaction Fouling Due to Milk", Sandu, C. and Lund, D., in *Fouling and Cleaning in Food Processing* (editors Lund, D., Plett, E., and Sandu, C.), pp. 122–167, University of Wisconsin-Madison Extension Duplicating, Madison, 1985; and, "Model Studies of Food Fouling", Gotham, S. M., Fryer, P. J., and Pritchard, A. M., in *Fouling and Cleaning in Food Processing* (editors Kessler, H. B. and Lund, D. B.), pp. 1–13, Druckerei Walch, Augsburg, 1989; and "Fouling of Milk Proteins and Salts-Reduction of Fouling by Technological Measures", Kessler, H. B., Ibid., pp. 37–45.

Theory suggests that irreversible protein adsorption begins as a tenacious monomolecular layer tightly bound by protein-surface interfacial forces. Polylayers and protein then deposit with repeated exposure, bound by protein—protein cohesive forces, each layer being progressively weaker in binding energy as the distance increases from the original substrate surface. Experimental observation and practical experience in milk process facilities confirm that several soil-clean cycles generally occur before protein films become visually discernable on surfaces, manifested by a light blue-brown to dark blue-black discoloration. Precise analytical confirmation can be made by a simple surface qualitative test utilizing Coomassie Brilliant Blue dye, which exists in two color forms—red and blue, the red rapidly converting to blue upon contact with protein. This dye-protein complex has a high extinction coefficient effecting great sensitivity in both qualitative and quantitative measurement of protein (see "The Use of Coomassie Brilliant Blue G250 Perchloric Acid Solution for Staining in Electrophoresis and Isoelectric Focusing on Polyacrylamide Gels"; Reisner, A. H., Nemes, P. and Bucholtz, C.; *Analytical Biochemistry*, Vol. 64, pp. 509–516 (1975); and, "A Rapid and Sensitive Method for the Quantitation of Microgram Quantities of Protein Utilizing the Principle of Protein-Dye Binding"; Bradford, M. M., *Analytical Biochemistry*, Vol. 72, pp. 248–254 (1976)).

As additional layers of protein deposit one upon another, a maximum thickness is likely reached above which cohesive protein—protein binding forces can be overcome by the mechanical, thermal, an detersive energies delivered to the soil by the cleaning program. This would explain results of elution experiments wherein surfaces previously soiled with milk and cleaned are then subjected to a second cleaning process having higher mechanical, thermal and detersive energies which can strip additional protein. However, practical observations suggest that protein films remain even at extremes of cleaning program conditions. A mechanism different than preferential displacement from absorptive sites is needed for protein film removal.

Researchers conducting soil removal experiments in the 1950's with the then new concept of recirculation cleaning (latter termed clean-in-place or CIP to encompass different methodologies) observed the occurrence of protein films on milk process equipment surfaces. Subsequently, the addition of hypochlorite to CIP alkaline detergent compounds was found to help remove protein film; and, this technology has been employed to-date by suppliers of cleaning compounds to the general food process industry. (For example, see "Effect of Added Hypochlorite on Detergent Activity of Alkaline Solutions in Recirculation Cleaning", MacGregor, D. R., Elliker, P. R., and Richardson, G. A., *Jnl. of Milk & Food Technology*, Vol. 17, pp. 136–138 (1954); "Further Studies on In-Place Cleaning", Kaufmann, O. W., Andrews, R. H., and Tracy, P. H., *Journal of Dairy Science*, Vol. 38, No. 4, 371–379 (1955); and, "Formation and Removal of an Iridescent Discoloration in Cleaned-In-Place Pipelines", Kaufmann, O. W. and Tracy, P. H., Ibid., Vol. 42, pp. 1883–1885 (1959).

Chlorine degrades protein by oxidative cleavage and hydrolysis of the peptide bond, which breaks apart large protein molecules into smaller peptide chains. The conformational structure of the protein disintegrates, dramatically lowering the binding energies, and effecting desorption from the surface, followed by solubilization or suspension into the cleaning solution.

The use of chlorinated detergent solutions in the food process industry is not without problems. Corrosion is a constant concern, as is degradation of polymeric gaskets, hoses, and appliances. Practice indicates that available chlorine concentrations must initially be at least 75, and preferably, 100 ppm for optimum protein film removal. At concentrations of available chlorine less than 50 ppm, protein soil build-up is enhanced by formation of insoluble, adhesive chloro-proteins (see "Cleanability of Milk-Filmed Stainless Steel by Chlorinated Detergent Solutions", Jensen, J. M., *Journal of Dairy Science*, Vol. 53, No. 2, pp. 248–251 (1970). Chlorine concentrations are not easy to maintain or analytically discern in detersive solutions. The dissipation of available chlorine by soil residues has been well established; and, chlorine can form unstable chloramino derivatives with proteins which titrate as available chlorine. The effectiveness of chlorine on protein soil removal diminishes as solution temperature and pH decrease—lower temperatures affecting reaction rate, and lower pH favoring chlorinated additional moieties.

These problems associated with the use and applications of chlorine release agents in the food process industry have been known and tolerated for decades. Chlorine has improved cleaning efficiency, and improved sanitation resulting in improved product quality. No safe and effective, lower cost alternative has been advanced by the detergent manufacturers.

However, a new issue may force change upon both the food process industry and the detergent manufacturers—the growing public concern over the health and environmental impacts of chlorine and organochlorines. Whatever the merits of the scientific evidence regarding carcinogenicity, there is little argument that organohalogen compounds are persistent and bioaccumulative; and that many of these compounds pose greater non-cancer health effects—endocrine, immune, and neurological problems—principally in the offspring of exposed humans and wildlife, at extremely low exposure levels. It is, therefore, prudent for the food process industry and their detergent suppliers to refocus on finding alternatives to the use of chlorine release agents in cleaning compositions.

A substantial need exists for a non-chlorine, protein film stripping agent for detergent compositions having applications in the food process industry, and having the versatility to remedy the problems heretofore described and presently unresolved.

Although enzymes were discovered in the early 1830's and their importance prompted intensive study by biochemists, public record of research into applications of enzymes in detergents first occurred in 1915 when German Patent No. 283,923 issued (May 4) to O. Rohm, founder of Rohm & Haas for application of pancreatic enzymes in laundry wash products. E. Jaag of the Swiss firm Gebrueder Schnyder developed this enzyme detergent concept further over the course of 30 years work; and, in 1959, introduced to market a laundry product, Bio 40, which contained a bacterial protease having considerable advantages over pancreatic trypsin. However, this bacterial protease was still not sufficiently stable at normal use pH of 9–10 and had marginal activity upon typical stains. It took several more years of research, until the mid 1960's, before bacterial alkaline proteases were commercial which had all of the necessary pH stability and soil reactivity characteristics for detergent applications.

Although use of enzymes in cleaning compositions did exist prior (see for example U.S. Pat. No. 1,882,279 to Frelinghuysen issued Oct. 11, 1932), large scale commercial enzyme containing laundry detergents first appeared in the United States in test market during 1966. Since that time, a large, but narrowly focused number of patents have been issued and reference articles published which disclose detergent compositions containing alkaline protease or enzyme class and subclass admixtures generally of proteases, carbohydrases and esterases. The vast majority of these patents target enzyme applications in consumer laundry pre-soak or wash cycle detergent compositions and consumer automatic dishwashing detergents. Close scrutiny of this patent library discloses the evolution of formula development in these product categories from simple powders containing alkaline protease (see for example U.S. Pat. No. 3,451,935 to Roald et al., issued Jun. 24, 1969) to more complex granular compositions containing multiple enzymes (see for example U.S. Pat. No. 3,519,570 to McCarty issued Jul. 7, 1970); to liquid compositions containing enzymes.

The progression from dry to liquid detergent compositions containing enzymes was a natural consequence of inherent problems with dry powder forms. Enzyme powders or granulates tended to segregate in these mechanical mixtures resulting in non-uniform, and hence undependable, product in use. Precautions had to be taken with packaging and in storage to protect the product from humidity which caused enzyme degradation. Dry powdered compositions are not as conveniently suited as liquids for rapid solubility or miscibility in cold and tepid waters nor functional as direct application products to soiled surfaces. For these reasons and for expanded applications, it became desirable to have liquid enzyme compositions.

Economic as well as processing considerations suggest the use of water in liquid enzyme compositions. However, there are also inherent problems in formulating enzymes into aqueous compositions. Enzymes generally denature or degrade in an aqueous medium resulting in the serious reduction or complete loss of enzyme activity. This instability results from at least two mechanisms. Enzymes have three-dimensional protein structure which can be physically or chemically changed by other solution ingredients, such as surfactants and builders, causing loss of catalytic effect. Alternately when protease is present in the composition, the protease will cause proteolytic digestion of the other enzymes if they are not proteases; or of itself via a process called autolysis.

Examples in the prior art have attempted to deal with these aqueous induced enzyme stability problems by minimizing water content (see U.S. Pat. No. 3,697,451 to Mausner et al. issued Oct. 10, 1972) or altogether eliminating water from the liquid enzyme containing composition (see U.S. Pat. No. 4,753,748 to Lailem et al. issued Jun. 28, 1988). As disclosed in Mausner et al. (Ibid.) and apparent from Lailem et al. (Ibid.), water is advantageous to dissolve the enzyme(s) and other water soluble ingredients, such as builders, and effectively carry or couple them into the non-aqueous liquid detergent vehicle to effect a homogenous, isotropic liquid which will not otherwise phase separate.

In order to market an aqueous enzyme composition, the enzyme must be stabilized so that it will retain its functional activity for prolonged periods of (shelf-life or storage) time. If a stabilized enzyme system is not employed, an excess of enzyme is generally required to compensate for expected loss. Enzymes are, however, expensive and are the most costly ingredients in a commercial detergent even though they are present in relatively minor amounts. Thus, it is no surprise that methods of stabilizing enzyme-containing, aqueous, liquid detergent compositions are extensively described in the patent literature. (See, Guilbert, U.S. Pat. No. 4,238,345).

Whereas the stabilizers used in liquid aqueous enzyme detergent compositions inhibit enzyme deactivation by chemical intervention, the literature also includes enzyme compositions which contain high percentages of water, but the water or the enzyme or both are immobilized; or otherwise physically separated to prevent hydrolytic interaction. For example of any aqueous enzyme encapsulate formed by extrusion, see U.S. Pat. No. 4,087,368 to Borrello issued May 2, 1978. For example of a gel-like aqueous based enzyme detergent, see U.S. Pat. No. 5,064,553 to Dixit et al. issued Nov. 12, 1991. For example of a dual component, two-package composition wherein the enzyme is separated from the alkalies, builders and sequestrants, see U.S. Pat. No. 4,243,543 to Guilbert et al. issued Jan. 6, 1981.

Enzyme containing detergent compositions presently have very limited commercial applications within the food process industries. A small, but significant application for enzymes with detergents is the cleaning of reverse osmosis and ultra filtration (RO/UF) membranes—porous molecular sieves not too dissimilar from synthetic laundry fabrics. Hard surface cleaning applications are almost non-existent with exception of high foam detergents containing enzymes being used occasionally in red meat processing plants for general environmental cleaning.

In 1985, a paper authored by D. R. Kane and N. E. Middlemiss entitled "Cleaning Chemicals-State of the Knowledge in 1985" (in *Fouling and Cleaning in Food Processing*; editors Lund, D. Plett, E., and Sandu, C.; pp. 312–335, University of Wisconsin-Madison Extension Duplicating, Madison, 1985) was delivered to the Second International Conference of Fouling and Cleaning in Food Processing. This paper emphasized CIP (clean-in-place) cleaning in the dairy industry. Within the text of this paper, the authors conclude that enzyme use in the food cleaning industry is not widespread for several reasons including enzyme instability at high pH and over time, enzyme and enzyme stabilizer cost, concern about residual enzyme and adverse effect on foodstuff quality, enzyme incompatibility with chlorine, slow enzyme reactivity necessitating long cleaning cycle times, and no commercial justification.

The present invention addresses and resolves these issues and problems.

The patent art does contain prior disclosure of enzyme containing detergent compositions having application on food process equipment. U.S. Pat. No. 4,169,817 to Weber issued Oct. 2, 1979 discloses a liquid cleaning composition containing detergent builders, surfactants, enzyme and stabilizing agent. The compositions claimed by Weber may be employed as a laundry detergent, a laundry pre-soak, or as a general purpose cleaner for dairy and cheese making processing equipment. The detergent solution of Weber generally has a pH in the range of 7.0 to 11.0.

The aforementioned prior teaching embodies high foam surfactants and fails to provide detergents which can be utilized in CIP cleaning systems.

U.S. Pat. No. 4,212,761 to Ciaccio issued Jul. 15, 1980 discloses a neat or use solution composition containing a ratio of sodium carbonate and sodium bicarbonate, a surfactant, an alkaline protease, and optionally sodium tripolyphosphate. The detergent solution of Ciaccio is used for cleaning dairy equipment including clean-in-place methods. The pH of the use solution in Ciaccio ranges from 8.5 to 11.

In Ciaccio, no working examples of detergent concentrate embodiments are disclosed. Ciaccio only asserts that the desirable detergent form would be as a premixed particulate. From the ingredient ranges discussed, it becomes obvious to one skilled in the art that such compositions would be too wet, sticky, and mull-like in practice to be readily commercialized.

U.S. Pat. Nos. 4,238,345 and 4,243,543 to Guilbert issued Jan. 6, 1981 teach a liquid two-part cleaning system for clean-in-place applications wherein one part is a concentrate which consists essentially of a proteolytic enzyme, enzyme stabilizers, surfactant and water; with the second concentrated part comprised of alkalies, builders, sequestrants and water. When both parts were blended at use dilution in Guilbert, the pH of this use solution was typically 11 or 12.

U.S. Pat. No. 5,064,561 to Rouillard issued Nov. 12, 1991 discloses a two-part cleaning system for use in clean-in-place facilities. Part one is a liquid concentrate consisting of a highly alkaline material (NaOH), defoamer, solubilizer or emulsifier, sequestrant and water. Part two is a liquid concentrate containing an enzyme which is a protease generally present as a liquid or as a slurry within a non-aqueous carrier which is ordinarily an alcohol, surfactant, polyol or mixture thereof. The use solution of Rouillard generally has a pH of about 9.5 to about 10.5.

Rouillard teaches the use of high alkaline materials; and, paradoxically, the optional use of buffers to stabilize the pH of the composition. Rouillard's invention discloses compositions wherein unstable aqueous mixtures of inorganic salts and organic defoamer are necessarily coupled by inclusion of a solubilizer or emulsifier to maintain an isotropic liquid concentrate. Rouillard further teaches that the defoamer may not always be required if a liquid (the assumption of term is "aqueous, stabilized") form of the enzyme is used in the second concentrate. This disclosure would seem to result from the use of Esperase 8.0 SL™ identified as a useful source of enzyme in the practice of the invention and utilized in working examples. Additional detail indicates Esperase 8.0 SL™ is a proteolytic enzyme suspended in Tergitol 15-S-9™, a high foam surfactant—hence the need for a defoamer and for a solubilizer or emulsifier. Rouillard still further discloses that proteolytic enzyme (Esperase 8.0 SL™) of an by itself does not clean as effectively as a high alkaline, chlorinated detergent unless mixed with its cooperative alkaline concentrate.

SUMMARY OF THE INVENTION

This invention discloses formulations, methods of manufacture and methods of use for compositional embodiments having application as detergents in the food process industry. Said compositions are used in cleaning food soiled surfaces. The materials are made in concentrated form. The diluted concentrate when delivered to the targeted surfaces will provide cleaning. The concentrate products can be a one part or a two part product in a liquid or emulsion form; a solid, tablet, or encapsulate form; a powder or particulate form; a gel or paste; or a slurry or mull. Especially useful are the concentrate products in powder or solid block form. The concentrate products being manufactured by any number of liquid and solid blending methods known to the art inclusive of casting, pour-molding, compressions-molding, extrusion-molding or similar shape - packaging operations. Said products being enclosed in metal, plastic, composite, laminate, paper, paperboard, or water soluble protective packaging. Said products being designed for clean-in-place (CIP), and clean-out-of-place (COP) cleaning regimens in food process industries such as dairy farm; fluid milk and processed milk by-product; red meat, poultry, fish, and respective processed by-products; soft drink, juice, and fermented beverages; egg, dressings, condiments, and other fluid food processing;and, fresh, frozen, canned or ready-to-serve processed foodstuffs.

More specifically, the present invention describes detergent compositions generally containing enzymes, surfactants, low alkaline builders, water conditioning agents; and, optionally a variety of formulary adjuvants depending upon product form and application such as (but not limited to) enzyme stabilizers, thickeners, solidifiers, hydrotropes, emulsifiers, solvents, antimicrobial agents, tracer molecules, coloring agents; and, inert organic or inorganic fillers and carriers.

The claimed compositions eliminate the need for high alkaline builders, auxiliary defoamers, corrosion inhibitors, and chlorine release agents. Accordingly the claimed compositions are safer to use and resulting effluent is friendly to the environment. When used, the claimed composition will continue to clean soiled food process equipment surfaces equal to or better than present, conventional chlorinated-high alkaline detergents.

We have also found oxidizing sanitizing agents that when applied to pre-cleaned and pre-rinsed surfaces as a final sanitizing rinse, following a cleaning program utilizing enzyme containing detersive solutions, have a surprising profound deactivating effect upon residual enzymes.

We have also found preferred methods of cleaning protein containing food processing units. In the preferred methods of the invention, the food processing units having at least some minimal film residue derived from the protein containing food product, is contacted with a protease containing detergent composition of the invention. Optionally, prior to contacting the food processing surface with the detergent, the unit can be prerinsed with an aqueous rinse composition to remove gross food soil. The protein residue on the food processing unit is contacted with a detergent of the invention for a sufficient period of time to remove the protein film. Any protease enzyme residue remaining on the surfaces of the unit or otherwise within the food processing unit, can be denatured using a variety of techniques. The food processing unit can be heated with a heat source comprising steam, hot water, etc. above the denaturing temperature of the protease enzyme. Typically, temperatures required range from about 60°–90° C., preferably about 60°–80° C. Further, the residual protease enzyme remaining in the food processing unit can be denatured by exposing the enzyme to an extreme pH. Typically, a pH greater than about 10, preferably greater than about 11 (alkaline pH) or less than 5, preferably less than about 4 (acid pH) is sufficient to denature the enzyme.

Additionally, the protease can be denatured by exposing any residual protease enzyme to the effects of an oxidizing agent. A variety of known oxidizing agents that also have the benefit of acting as a food acceptable sanitizer include aqueous hydrogen peroxide, aqueous ozone containing compositions, aqueous peroxy acid compositions wherein the peroxy acid comprises a per $C_{1-24}$ monocarboxylic or dicarboxylic acid composition. Additionally, hypochlorite, iodophors and interhalogen complexes (ICl, ClBr, etc.) can be used to denature the enzyme if used in accordance with accepted procedures.

Denatured enzyme remaining in the system after the denaturing step can have little or no effect on any proteinaceous food. The resulting product quality is unchanged. Preferred foods treated in food processing units having a denaturing step following the cleaning step include milk and dairy products, beer and other fermented malt beverages, puddings, soups, yogurt, or any other liquid, thickened liquid, or semisolid protein containing food material.

The objectives of this product invention are thus to:

provide the food process industry and operations concerned about environmental hygiene with a low alkaline, non-chlorine detergent alternative to conventional products;

satisfy a commercial need for cost effective, user friendly, less environmentally intrusive detergents;

facilitate utility and scope of application with a family of said detergents having diverse physical form and differing composition for a broad range of food soil type and cleaning program parameter variations; and resolve objections to the use of detersive enzymes for cleaning in food process environments which are sensitive to enzyme residuals by teaching cooperative cleaning and sanitizing programs which assure complete deactivation of enzyme prior to food contact.

DETAILED DESCRIPTION OF THE INVENTION

Figure 1:
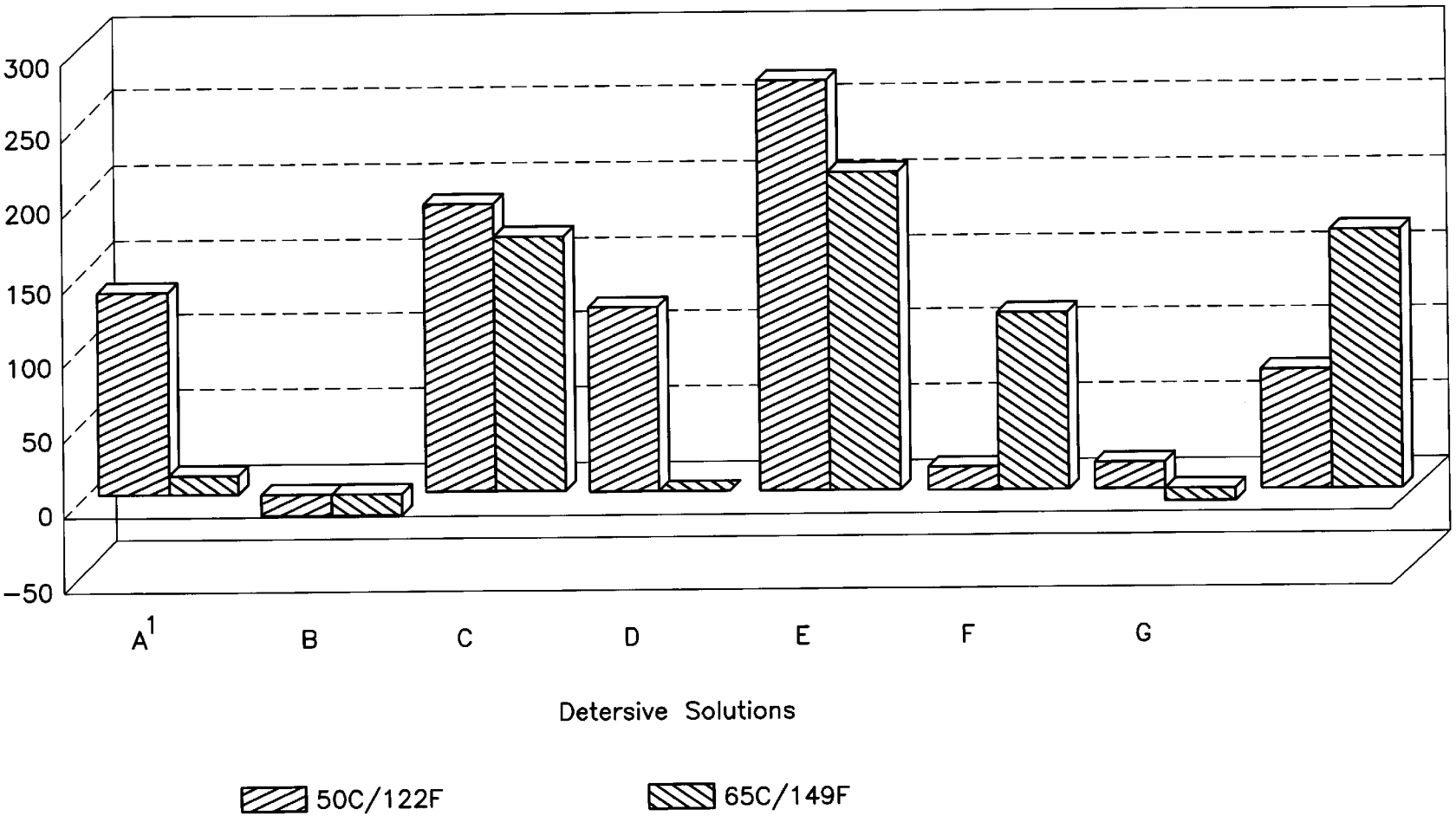
FIG. 1 is Protein Film Soil Removal Test.

The invention comprises a use dilution, use-solution composition having exceptional detergency properties when applied as a cleaning treatment to food soiled equipment surfaces and having particular cleaning efficiency upon tenacious protein films. Preferred embodiments of the invention provide cleaning performance superior to conventional high alkaline, chlorine containing detergents. The present invention generally comprises in a low foaming formulation free of an alkaline metal hydroxide or a source of active chlorine.

1. an enzyme or enzyme mixture
2. an enzyme stabilizing system
3. a surfactant or surfactant mixture
4. a low alkaline builder or builder mixture
5. a water conditioning agent or mixture
6. water; and,
7. optional adjuvants This invention also comprises concentrate formulations which when dispersed, dissolved, and properly diluted in water will provide preferred use-solution compositions. The concentrates can be liquid or emulsion; solid block, tablet, or encapsulate; powder or particulate; gel or paste; slurry or mull.

This invention further comprises concentrated cleaning treatments consisting of one product; or, consisting of a two product system wherein proportions of each are blended.

A preferred concentrate embodiment of the invention is a one part solid block detergent system comprising:

a. an enzyme or enzyme mixture
b. a surfactant or surfactant mixture
c. a low alkaline builder or builder mixture
d. a water conditioning agent or mixture; and
e. water.

Another preferred concentrate of the invention is a powdered detergent system comprising:

a. an enzyme or enzyme mixture
b. an enzyme stabilizer
c. a surfactant or surfactant mixture
d. a water conditioning agent or mixture; and
e. water.

Still another preferred concentrate embodiment of this invention is a two part, two product detergent system which comprises:

1. a concentrated liquid product comprising:
   a. an enzyme or enzyme mixture
   b. an enzyme stabilizing system
   c. a surfactant or surfactant mixture
   d. a hydrotrope or solvent or mixture
   e. water; and
2. a cooperative second concentrated liquid product comprising:
   a. a low alkaline builder or builder mixture
   b. a water conditioning agent or mixture; and
   c. water A detersive use solution is prepared by admixing portions of each product concentrate with water such that the first liquid concentrate is present in an amount ranging from about 0.001 to 1% preferably about 0.02% (200 ppm) to about 0.10% (1000 ppm); and, the second liquid concentrate is present in an amount ranging from about 0.02% (200 ppm) to about 0.10% (1000 ppm). Total cooperative admixture use solution concentration ranges from about 0.01% to 2.0% preferably about 0.04% (400 ppm) to about 0.20% (2000 ppm). The pH range of the total cooperative admixture use solution is from about 7.5 to about 11.5.

I. Enzymes

Enzymes are important and essential components of biological systems, their function being to catalyze and facilitate organic and inorganic reactions. For example, enzymes are essential to metabolic reactions occurring in animal and plant life.

The enzymes of this invention are simple proteins or conjugated proteins produced by living organisms and functioning as biochemical catalysts which, in detergent technology, degrade or alter one or more types of soil residues encountered on food process equipment surfaces thus removing the soil or making the soil more removable by the detergent-cleaning system. Both degradation and alteration of soil residues improve detergency by reducing the physicochemical forces which bind the soil to the surface being cleaned, i.e. the soil becomes more water soluble.

As defined in the art, enzymes are referred to as simple proteins when they require only their protein structures for catalytic activity. Enzymes are described as conjugated proteins if they require a non-protein component for activity, termed cofactor, which is a metal or an organic biomolecule often referred to as a coenzyme. Cofactors are not involved in the catalytic events of enzyme function. Rather, their role seems to be one of maintaining the enzyme in an active configuration. As used herein, enzyme activity refers to the ability of an enzyme to perform the desired catalytic function of soil degradation or alteration; and, enzyme stability pertains to the ability of an enzyme to remain or to be maintained in the active state.

Enzymes are extremely effective catalysts. In practice, very small amounts will accelerate the rate of soil degradation and soil alteration reactions without themselves being consumed in the process. Enzymes also have substrate (soil) specificity which determines the breadth of its catalytic effect. Some enzymes interact with only one specific substrate molecule (absolute specificity); whereas, other enzymes have broad specificity and catalyze reactions on a family of structurally similar molecules (group specificity).

Enzymes exhibit catalytic activity by virtue of three general characteristics: the formation of a noncovalent complex with the substrate, substrate specificity, and catalytic rate. Many compounds may bind to an enzyme, but only certain types will lead to subsequent reaction. The later are called substrates and satisfy the particular enzyme specificity requirement. Materials that bind but do not thereupon chemically react can affect the enzymatic reaction either in a positive or negative way. For example, unreacted species called inhibitors interrupt enzymatic activity.

Enzymes which degrade or alter one or more types of soil, i.e. augment or aid the removal of soils from surfaces to be cleaned, are identified and can be grouped into six major classes on the basis of the types of chemical reactions which they catalyze in such degradation and alteration processes. These classes are (1) oxidoreductase; (2) transferase; (3) hydrolase; (4) lyase; (5) isomerase; and (6) ligase.

Several enzymes may fit into more than one class. A valuable reference on enzymes is "Industrial Enzymes", Scott, D., in *Kirk-Othmer Encyclopedia of Chemical Technology*, 3rd Edition, (editors Grayson, M. and EcKroth, D.) Vol. 9, pp. 173–224, John Wiley & Sons, New York, 1980.

In summary, the oxidoreductases, hydrolases, lyases and ligases degrade soil residues thus removing the soil or making the soil more removable; and, transferases and isomerases alter soil residues with same effect. Of these enzyme classes, the hydrolases (including esterase, carbohydrase or protease) are particularly preferred for the present invention.

The hydrolases catalyze the addition of water to the soil with which they interact and generally cause a degradation or breakdown of that soil residue. This breakdown of soil residue is of particular and practical importance in detergent applications because soils adhering to surfaces are loosened and removed or rendered more easily removed by detersive action. Thus, hydrolases are the most preferred class of enzymes for use in cleaning compositions. Preferred hydrolases are esterases, carbohydrases, and proteases. The most preferred hydrolase sub-class for the present invention is the proteases.

The proteases catalyze the hydrolysis of the peptide bond linkage of amino acid polymers including peptides, polypeptides, proteins and related substances-generally protein complexes—such as casein which contains carbohydrate (glyco group) and phosphorus as integral parts of the protein and exists as distinct globular particles held together by calcium phosphate; or such as milk globulin which can be thought of as protein and lipid sandwiches that comprise the milk fat globule membrane. Proteases thus cleave complex, macromolecular protein structures present in soil residues into simpler short chain molecules which are, of themselves, more readily desorbed from surfaces, solubilized or otherwise more easily removed by detersive solutions containing said proteases.

Proteases, a sub-class of hydrolases, are further divided into three distinct subgroups which are grouped by the pH optima (i.e. optimum enzyme activity over a certain pH range). These three subgroups are the alkaline, neutral and acids proteases. These proteases can be derived from vegetable, animal or microorganism origin; but, preferably are of the latter origin which includes yeasts, molds and bacteria. More preferred are serine active, alkaline proteolytic enzymes of bacterial origin. Particularly preferred for embodiment in this invention are bacterial, serine active, alkaline proteolytic enzymes obtained from alkalophilic strains of Bacillus, especially from *Bacillus subtilis* and *Bacillus licheniformis*. Purified or non-purified forms of these enzymes may be used. Proteolytic enzymes produced by chemically or genetically modified mutants are herein included by definition as are close structural enzyme variants. These alkaline proteases are generally neither inhibited by metal chelating agents (sequestrants) and thiol poisons nor activated by metal ions or reducing agents. They all have relatively broad substrate specificities, are inhibited by diisopropylfluorophosphate (DFP), are all endopeptidases, generally have molecular weights in the range of 20,000 to 40,000, and are active in the pH ranges of from about 6 to about 12; and, in the temperature range of from about 20° C. to about 80° C.

Examples of suitable commercially available alkaline proteases are Alcalase®, Savinase®, and Esperase®—all of Novo Industri AS, Denmark; Puratect® of Genencor International; Maxacal®, Maxapem® and Maxatase®—all of Gist-Brocase International NV, Netherlands; Optimase® and Opticlean® of Solvay Enzymes, USA and so on.

Commercial alkaline proteases are obtainable in liquid or dried form, are sold as raw aqueous solutions or in assorted purified, processed and compounded forms, and are comprised of about 2% to about 80% by weight active enzyme generally in combination with stabilizers, buffers, cotactors, impurities and inert vehicles. The actual active enzyme content depends upon the method of manufacture and is not critical, assuming the detergent solution has the desired enzymatic activity. The particular enzyme chosen for use in the process and products of this invention depends upon the conditions of final utility, including the physical product form, use pH, use temperature, and soil types to be degraded or altered. The enzyme can be chosen to provide optimum activity and stability for any given set of utility conditions. For example, Purafect® is a preferred alkaline protease for use in detergent compositions of this invention having application in lower temperature cleaning programs—from about 30° C. to about 65° C.; whereas, Esperase® is the alkaline protease of choice for higher temperature detersive solutions, from about 50° C. to about 85° C.

In preferred embodiments of this invention, the amount of commercial alkaline protease composite present in the final use-dilution, use-solution ranges from about 0.001% (10 ppm) by weight of detersive solution to about 0.02% (200 ppm) by weight of solution.

Whereas establishing the percentage by weight of commercial alkaline protease required is of practical convenience for manufacturing embodiments of the present teaching, variance in commercial protease concentrates and in-situ environmental additive and negative effects upon protease activity require a more discerning analytical technique for protease assay to quantify enzyme activity and establish correlations to soil residue removal performance and to enzyme stability within the preferred embodiment; and, if a concentrate, to use-dilution solutions. The activity of the alkaline proteases of the present invention are readily expressed in terms of activity units—more specifically, Kilo-Novo Protease Units (KNPU) which are azocasein assay activity units well known to the art. A more detailed discussion of the azocasein assay procedure can be found in the publication entitled "The Use of Azoalbumin as a Substrate in the Colorimetric Determination of Peptic and Tryptic Activity", Tomarelli, R. M., Charney, J., and Harding, M. L., *J. Lab. Clin. Chem.* 34, 428 (1949), incorporated herein by reference.

In preferred embodiments of the present invention, the activity of proteases present in the use-solution ranges from about $1\times10^{-5}$ KNPU/gm solution to about $4\times10^{-3}$ KNPU/gm solution.

Naturally, mixtures of different proteolytic enzymes may be incorporated into this invention. while various specific enzymes have been described above, it is to be understood that any protease which can confer the desired proteolytic activity to the composition may be used and this embodiment of this invention is not limited in any way by specific choice of proteolytic enzyme.

In addition to proteases, it is also to be understood, and one skilled in the art will see from the above enumeration, that other enzymes which are well known in the art may also be used with the composition of the invention. Included are other hydrolases such as esterases, carboxylases and the like; and, other enzyme classes.

Further, in order to enhance its stability, the enzyme or enzyme admixture may be incorporated into various non-liquid embodiments of the present invention as a coated, encapsulated, agglomerated, prilled or marumerized form.

II. Enzyme Stabilizing System

The enzyme stabilizing system of the present invention is adapted from Guilbert in U.S. Pat. No. 4,238,345 issued Dec. 9, 1980; and further disclosed by Guilbert et al. in U.S. Pat. No. 4,243,543 issued Jun. 6, 1981—both incorporated herein by reference.

The most preferred stabilizing system for the present invention consists of a soluble metabisulfite salt, a glycol such as propylene glycol, and an alkanol amine compound such as triethanolamine. The admixture of this complete stabilizing system for maintaining enzyme activity within the most preferred two part, two product concentration embodiment of this invention will typically range from about 0.5% by weight to about 30% by weight of the total enzyme containing composition. Within the formulary range of the total stabilizing admixture, sodium metabisulfite will typically comprise from about 0.1% by weight to about 5.0% by weight; propylene glycol will typically comprise from about 1% by weight to about 25% by weight; and, triethanolamine will typically comprise from about 0.7% by weight to about 15% by weight.

This stabilizing system provides stabilizing effect to enzymes in water containing compositions consisting of about 20% by weight to about 90% by weight of water, per Guilbert (Ibid.). It seems obvious to conclude that this enzyme stabilizing system would therefor provide some degree of stabilizing effect to enzyme activity at all levels of free and bound waters existing in a liquid enzyme detergent composition, typically from about 1% to about 99% by weight of water.

We have found that incorporation of the preferred enzyme stabilizing system has pronounced beneficial effect upon alkaline protease cleaning performance, i.e. enhanced protein film removal, in use-dilution solutions. Normally, employed for shelf-life maintenance of enzyme activity within the product concentrate, none of the art discloses, teaches or suggests that enzyme stabilizing systems make any contribution to or have any expected cooperative action with enzyme activity or manifested cleaning performance improvement within detersive, use-dilution solution environments.

Furthermore, none of the art discloses, teaches, or suggests that such enzyme stabilizing systems will profoundly demonstrate this synergistic, cooperative effect at high temperatures otherwise destructive to enzymes or rendering them thermolabile.

We have found that the enzyme stabilizing system is not required in the one part solid block product. The use of a water soluble metal salt of an oxidizable oxygenated-sulfur anion may be used as an enzyme stabilizer in the one part powder product. Such anions are, for example, a metabisulfite, sulfite, thiosulfate, bisulfite or a mixture thereof. A preferred stabilizer is sodium metabisulfite.

Figure 2:
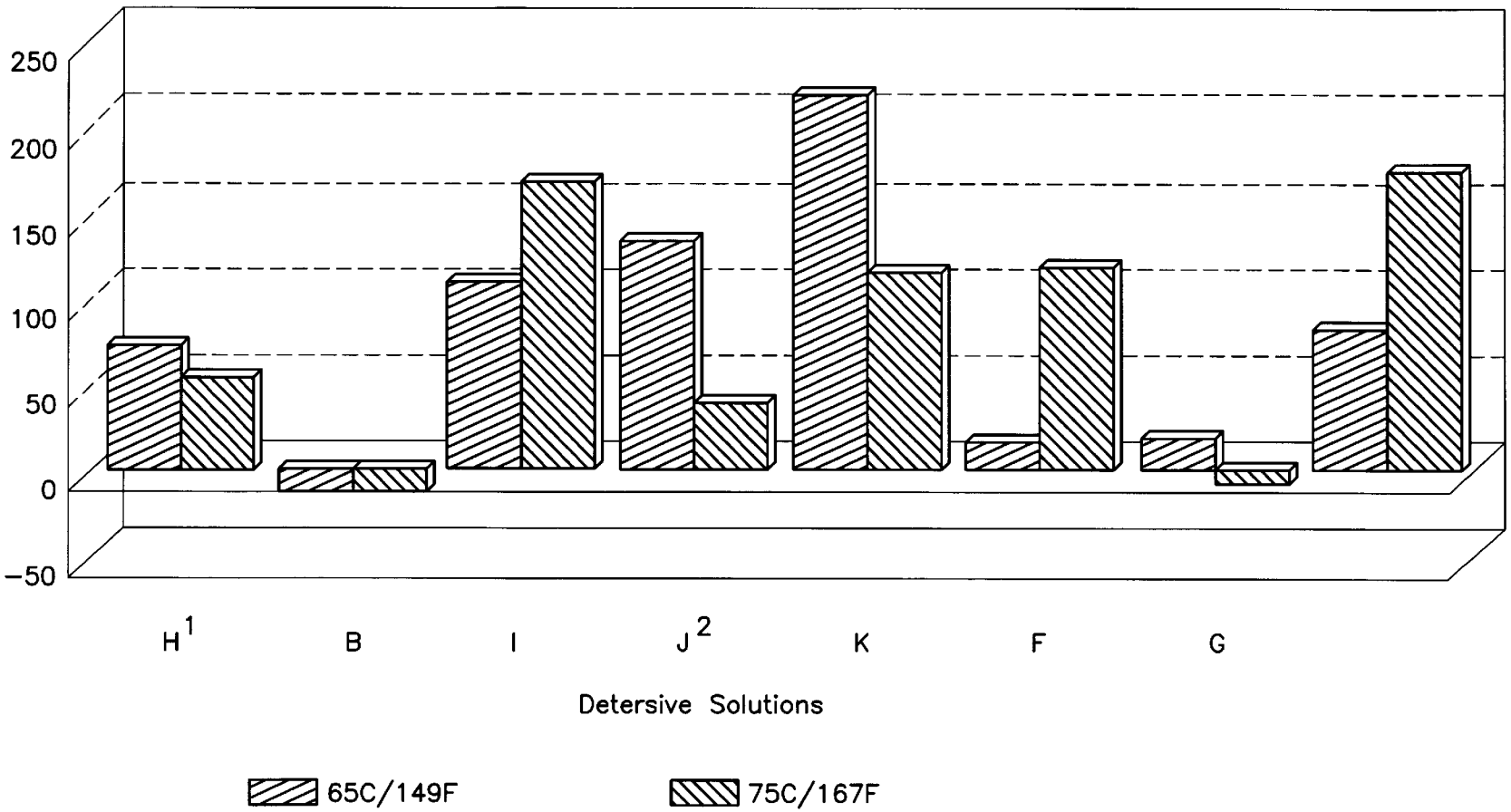
FIG. 2 is Protein Film Soil Removal.

For a more detailed discussion and illustrated measurement of this discovery, see TABLE A and FIGS. 1 and 2.

III. Surfactant

The surfactant or surfactant admixture of the present invention can be selected from water soluble or water dispersible nonionic, semi-polar nonionic, anionic, cationic, amphoteric, or zwitterionic surface-active agents; or any combination thereof.

The particular surfactant or surfactant mixture chosen for use in the process and products of this invention depends upon the conditions of final utility, including method of manufacture, physical product form, use pH, use temperature, foam control, and soil type.

Surfactants incorporated into the present invention must be enzyme compatible and free of enzymatically reactive species. For example, when proteases and amylases are employed, the surfactant should be free of peptide and glycosidic bonds respectively. Care should be taken in including cationic surfactants because some reportedly decrease enzyme effectiveness.

The preferred surfactant system of the invention is selected from nonionic or anionic species of surface-active agents, or mixtures of each or both types. Nonionic and anionic surfactants offer diverse and comprehensive commercial selection, low price; and, most important, excellent detersive effect—meaning surface wetting, soil penetration, soil removal from the surface being cleaned, and soil suspension in the detergent solution. This preference does not teach exclusion of utility for cationics, or for that sub-class of nonionic entitled semi-polar nonionics, or for those surface-active agents which are characterized by persistent cationic and anionic double ion behavior, thus differing from classical amphoteric, and which are classified as zwitterionic surfactants.

One skilled in the art will understand that inclusion of cationic, semi-polar nonionic, or zwitterionic surfactants; or, mixtures thereof will impart beneficial and/or differentiating utility to various embodiments of the present invention. As example, foam stabilization for detersive compositions designed to be foamed onto equipment or environmental floor, wall and ceiling surfaces; or, gel development for products dispensed as a clinging thin gel onto soiled surfaces; or, for antimicrobial preservation; or, for corrosion prevention—and so forth.

The most preferred surfactant system of the present invention is selected from nonionic or anionic surface-active agents, or mixtures of each or both types which impart low foam to the use-dilution, use solution of the detergent composition during application. Preferably, the surfactant or the individual surfactants participating within the surfactant mixture are of themselves low foaming within normal use concentrations and within expected operational application parameters of the detergent composition and cleaning program. In practice, however, there is advantage to blending low foaming surfactants with higher foaming surfactants because the latter often impart superior detersive properties to the detergent composition. Mixtures of low foam and high foam nonionics and mixtures of low foam nonionics and high foam anionics can be useful in the present invention if the foam profile of the combination is low foaming at normal use conditions. Thus high foaming nonionics and anionics can be judiciously employed without departing from the spirit of this invention.

Particularly preferred concentrate embodiments of this invention are designed for clean-in-place (CIP) cleaning systems within food process facilities; and, most particularly for dairy farm and fluid milk and milk by-product producers. Foam is a major concern in these highly agitated, pump recirculation systems during the cleaning program. Excessive foam reduces flow rate, cavitates recirculation pumps, inhibits detersive solution contact with soiled surfaces, and prolongs drainage. Such occurrences during CIP operations adversely affect cleaning performance and sanitizing efficiencies.

Low foaming is therefore a descriptive detergent characteristic broadly defined as a quantity of foam which does not manifest any of the problems enumerated above when the detergent is incorporated into the cleaning program of a CIP system. Because no foam is the ideal, the issue becomes that of determining what is the maximum level or quantity of foam which can be tolerated within the CIP system without causing observable mechanical or detersive disruption; and, then commercializing only formulas having foam profiles at least below this maximum; but, more practically, significantly below this maximum for assurance of optimum detersive performance and CIP system operation.

Acceptable foam levels in CIP systems have been empirically determined in practice by trial and error. obviously, commercial products exist today which meet the low foam profile needs of CIP operation. It is therefore, a relatively straightforward task to employ such commercial products as standards for comparison and to establish laboratory foam evaluation devices and test methods which simulate, if not duplicate, CIP program conditions, i.e. agitation, temperature, and concentration parameters.

In practice, the present invention permits incorporation of high concentrations of surfactant as compared to conventional chlorinated, high alkaline CIP and COP cleaners. Certain preferred surfactant or surfactant mixtures of the invention are not generally physically compatible nor chemically stable with the alkalis and chlorine of convention. This major differentiation from the art necessitates not only careful foam profile analysis of surfactants being included into compositions of the invention; but, also demands critical scrutiny of their detersive properties of soil removal and suspension. The present invention relies upon the surfactant system for gross soil removal from equipment surfaces and for soil suspension in the detersive solution. Soil suspension is as important a surfactant property in CIP detersive systems as soil removal to prevent soil redeposition on cleaned surfaces during recirculation and later re-use in CIP systems which save and re-employ the same detersive solution again for several cleaning cycles.

Generally, the concentration of surfactant or surfactant mixture useful in use-dilution, use solutions of the present invention ranges from about 0.002% (20 ppm) by weight to about 0.1% (1000 ppm) by weight, preferably from about 0.005% (50 ppm) by weight to about 0.075% (750 ppm) by weight, and most preferably from about 0.008% (80 ppm) by weight to about 0.05% (500 ppm) by weight.

The concentration of surfactant or surfactant mixture useful in the most preferred concentrated embodiment of the present invention ranges from about 5% by weight to about 75% by weight of the total formula weight percent of the enzyme containing composition.

A typical listing of the classes and species of surfactants useful herein appears in U.S. Pat. No. 3,664,961 issued May 23, 1972, to Norris, incorporated herein by reference. *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. Nonionic surfactants useful in the invention are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants in the present invention include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade name Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

2. Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. Examples of commercial compounds of this chemistry are available on the market under the trade name Igepal® manufactured by Rhone-Poulenc and Triton® manufactured by Union Carbide.

3. Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade name Neodol® manufactured by Shell Chemical Co. and Alfonic® manufactured by Vista Chemical Co.

4. Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade name Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Low foaming alkoxylated nonionics are preferred although other higher foaming alkoxylated nonionics can be used without departing from the spirit of this invention if used in conjunction with low foaming agents so as to control the foam profile of the mixture within the detergent composition as a whole. Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile comprising 10% by weight to about 80% by weight of the final molecule. These reverse Pluronics® are manufactured by BASF Corporation under the trade name Pluronic® R surfactants.

Likewise, the Tetraonic® R surfactants are produced by BASF Corporation by the sequential addition of ethylene oxide and propylene oxide to ethylenediamine. The hydrophobic portion of the molecule weighs from about 2,100 to about 6,700 with the central hydrophile comprising 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

7. Additional examples of effective low foaming nonionics include:

The alkylphenoxypolyethoxyalkanols of U.S. Pat. No. 2,903,486 issued Sep. 8, 1959 to Brown et al., hereby incorporated by reference, represented by the formula

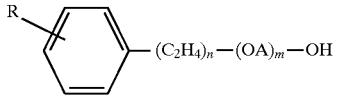

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al., hereby incorporated by reference, having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7 1968 to Lissant et al., incorporated herein by reference, having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al., incorporated herein by reference, corresponding to the formula $Y(C_3H_6O)_n(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al, incorporated herein by reference, having the formula $Y[(C_3H_6O_n(C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

The most preferred nonionic surfactants for use in compositions practiced in the present invention included compounds from groups (5), (6) and (7). Especially preferred are the modified compounds enumerated in groups (6) and (7).

Examples of especially preferred commercial surfactants are listed in Table II.

TABLE II

Examples of Preferred Commercial Nonionics

| General Structure | Examples[a] |
|---|---|
| AP-$(EO)_x$-$(PO)_y$H | Triton ® CF-21<br>$C_8P$ $(EO)_{9.5}(PO)_5$H<br>Texaco NPE 9.5 PO5<br>$C_9P$ $(EO)_{9.5}(PO)_5$ |
| Alcohol-$(EO)_x$-$(PO)_y$H | Surfonic ® JL-80X<br>$C_{9-11}(EO)_9(PO)_{1-2}$H |
| Alcohol-$(PO)_x$-$(EO)_y$H | Poly-Tergent ® SL-=42<br>$C_{8-10}(PO)_3(EO)_5$H |
| Alcohol-$(PO)_x$-$(EO)_y$-$(PO)_2$H | Poly-Tergent ® SLF-18<br>$C_{8-10}(PO)_{16-17}(EO)_{12}(PO)_{1-2}$H |
| Alcohol-$(PO)_x$-$(EO)_y$-benzyl | Triton ® DF-12<br>$C_{8-10}(PO)_2(EO)_{13}$-benzyl |
| Alcohol-$(EO)_x$-$(BuO)_y$H | Plurafac ® LF-221<br>$C_{10-12}(EO)_{9.5}(BuO)_{1-2}$ |
| Alcohol-$(EO)_x$-alkyl | Dehypon ® Lt-104<br>$C_{16-18}(EO)_{12}CH_2OC_4H_9$ |

TABLE II-continued

Examples of Preferred Commercial Nonionics

| General Structure | Examples[a] |
|---|---|
| Alcohol-$(EO)_x$-benzyl | Triton ® DF-18<br>$C_{14-16}(EO)_{16}$-benzyl |

[a]NMR analysis
AP = alkylphenoxy
EO = ethylene oxide
PO = propylene oxide
BUO = butylene oxide
Triton ® is a registered trade name of Union Carbide Chemical & Plastics Co.
Surfonic ® is a registered trade name of Texaco Chemical Co.
Poly-Tergent is a registered trade name of Olin Corporation.
Plurafac ® is a registered trade name of BASF Corporation.
Dehypon ® is a registered trade name of Henkel Corporation.

Semi-Polar Nonionic Surfactants

The semi-polar type of nonionic surface active agents are another class of nonionic surfactant useful in compositions of the present invention. Generally, semi-polar nonionics are high foamers and foam stabilizers which make their application in CIP systems limited. However, within compositional embodiments of this invention designed for high foam cleaning methodology, such as facility cleaning which often employs detersive solutions dispensed onto surfaces as a foam, semi-polar nonionics would have immediate utility. The semi-polar nonionic surfactants include the amine oxides, phosphine oxides, sulfoxides and their alkoxylated derivatives.

8. Amine oxides are tertiary amine oxides corresponding to the general formula:

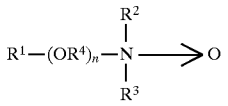

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are selected from the group consisting of alkyl or hydroxyalkyl of 1–3 carbon atoms and mixtures thereof; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl) amine oxides, specific examples of which are dodecyldimethylamine oxide, tridecyldimethylamine oxide, etradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

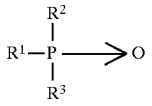

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants useful herein also include the water soluble sulfoxide compounds which have the structure:

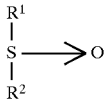

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counterions) associated with these polar groups, sodium, lithium and potassium impart water solubility; ammonium and substituted ammonium ions provide both water and oil solubility; and, calcium, barium, and magnesium promote oil solubility.

As those skilled in the art understand, anionics are excellent detersive surfactants and are therefore, favored additions to heavy duty detergent compositions. Generally, however, anionics have high foam profiles which limit their use alone or at high concentration levels in cleaning systems such as CIP circuits that require strict foam control. However, anionics are very useful additives to preferred compositions of the present invention; at low percentages or in cooperation with a low foaming nonionic or defoam agent for application in CIP and like foam controlled cleaning regimens; and, at higher concentrations in detergent compositions designed to yield foaming detersive solutions. Certainly, anionic surfactants are preferred ingredients in various embodiments of the present invention which incorporate foam for dispensing and utility—for example, clinging foams used for general facility cleaning.

Further, anionic surface active compounds are useful to impart special chemical or physical properties other than detergency within the composition. Anionics can be employed as gelling agents or as part of a gelling or thickening system. Anionics are excellent solubilizers and can be used for hydrotropic affect and cloud point control. Anionics can also serve as the solidifier for solid product forms of the invention, and so forth.

The majority of large volume commercial anionic surfactants can be subdivided into five major chemical classes and additional sub-groups: (taken from "Surfactant Encyclopedia", *Cosmetics & Toiletries*, Vol. 104 (2) 71–86 (1989); and incorporated herein by reference).

A. Acylamino acids (and salts)
   1. Acylgluamates
   2. Acyl peptides
   3. Sarcosinates
   4. Taurates B. Carboxylic acids (and salts)
   1. Alkanoic acids (and alkanoates)
   2. Ester carboxylic acids
   3. Ether carboxylic acids C. Phosphoric acid esters (and salts)

D. Sulfonic acids (and salts)
   1. Acyl isethionates
   2. Alkylaryl sulfonates
   3. Alkyl sulfonates
   4. Sulfosuccinates E. Sulfuric acid esters (and salts)
   1. Alkyl ether sulfates
   2. Alkyl sulfates It should be noted that certain of these anionic surfactants may be incompatible with the enzymes incorporated into the present invention. As example, the acyl-amino acids and salts may be incompatible with proteolytic enzymes because of their peptide structure.

Examples of suitable synthetic, water soluble anionic detergent compounds are the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives. Other anionic detergents are the olefin sulfonates, including long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule. The particular salts will be suitably selected depending upon the particular formulation and the needs therein.

The most preferred anionic surfactants for the most preferred embodiment of the invention are the linear or branched alkali metal mono and/or di-($C_{6-14}$)alkyl diphenyl oxide mono and/or disulfonates, commercially available from Dow Chemical, for example as DOWFAX® 2A-1, and DOWFAX® C6L.

Cationic Surfactants

Surface active substances are classified as cationic if the charge on the hydrotrope portion of the molecule is positive. Surfactants in which the hydrotrope carries no charge unless the pH is lowered close to neutrality or lower are also included in this group (e.g. alkyl amines). In theory, cationic surfactants may be synthesized from any combination of elements containing an "onium" structure $RnX^+Y^-$ and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, e.g. they are less expensive.

Cationic surfactants refer to compounds containing at least one long carbon chain hydrophobic group and at least one positively charge nitrogen. The long carbon chain group may be attached directly to the nitrogen atom by simple substitution; or more preferably indirectly by a bridging functional group or groups in so-called interrupted alkylamines and amido amines which make the molecule more hydrophilic and hence more water dispersible, more easily water solubilized by co-surfactant mixtures, or water soluble. For increased water solubility, additional primary, secondary or tertiary amino groups can be introduced or the amino nitrogen can be quaternized with low molecular weight alkyl groups. further, the nitrogen can be a member of branched or straight chain moiety of varying degrees of unsaturation; or, of a saturated or unsaturated heterocyclic ring. In addition, cationic surfactants may contain complex linkages having more than one cationic nitrogen atom.

The surfactant compounds classified as amine oxides, amphoterics and zwitterions are themselves cationic in near neutral to acidic pH solutions and overlap surfactant classifications. Polyoxyethylated cationic surfactants behave like nonionic surfactants in alkaline solution and like cationic surfactants in acidic solution. The simplest cationic amines, amine salts and quaternary ammonium compounds can be schematically drawn thus:

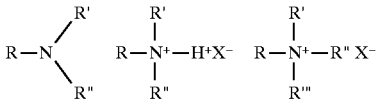

R represents a long alkyl chain, R', R", and R'" may be either long alkyl chains or smaller alkyl or aryl groups or hydrogen and X represents an anion. Only the amine salts and quaternary ammonium compounds are of practical use in this invention because of water solubility.

11. The majority of large volume commercial cationic surfactants can be subdivided into four major classes and additional sub-groups: (taken from "Surfactant Encyclopedia", *Cosmetics & Toiletries*, Vol. 104 (2) 86–96 (1989); and incorporated herein by reference.

A. Alkylamines (and salts)
B. Alkyl imidazolines
C. Ethoxylated amines
D. Quaternaries
  1. Alkylbenzyldimethylammonium salts
  2. Alkyl benzene salts
  3. Heterocyclic ammonium salts
  4. Tetra alkylammonium salts As utilized in this invention, cationics are specialty surfactants incorporated for specific effect; for example, detergency in compositions of or below neutral pH; antimicrobial efficacy; thickening or gelling in cooperation with other agents; and so forth.

The cationic surfactants useful in the compositions of the present invention have the formula $R_m^1R_x^2Y_LZ$ wherein each $R^1$ is an organic group containing a straight or branched alkyl or alkenyl group optionally substituted with up to three phenyl or hydroxy groups and optionally interrupted by up to four structure selected from the following group:

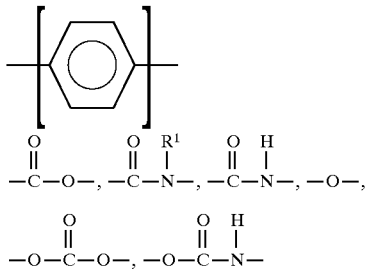

isomers and mixtures thereof, and which contains from about 8 to 22 carbon atoms. The $R^1$ groups may additionally contain up to 12 ethoxy groups. m is a number from 1 to 3. No more than one $R^1$ group in a molecule can have 16 or more carbon atoms when m is 2 or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens. Y is selected from the group consisting of, but not limited to:

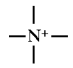

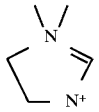

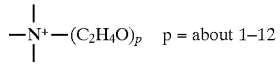

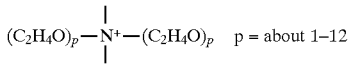

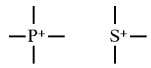

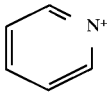

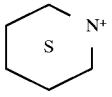

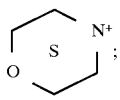

L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Amphoteric Surfactants

Amphoteric surfactants contain both a basic and an acidic hydrophilic group and an organic hydrophobic group. These ionic entities may be any of anionic or cationic groups described in the preceding sections. A basic nitrogen and an acidic carboxylate group are the predominant functional groups, although in a few structures, sulfonate, sulfate, phosphonate or phosphate provide the negative charge. Surface active agents are classified as amphoterics if the charge on the hydrophobe changes as a function of the solutions pH—to illustrate:

$$[RNH(CH_2)_nCO_2H]^+X^-\ ^1 \leftrightarrows [RN^+H_2(CH)_nCO_2^-]\ ^2 \leftrightarrows [RNH(CH^2)_nCO_2^-]M^+\ ^3$$

$X^-$ represents an anion and $M^+$ a cation.

[1] Low pH Solution: Cationic Hydrophobe

[2] Intermediate pH Solution: Isoelectric Hydrophobe

[3] High pH Solution: Anionic Hydrophobe

Ampholytic surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphate, or phosphono. Amphoteric surfactants are subdivided into two major classes: (taken from "Surfactant Encyclopedia" *Cosmetics & Toiletries*, Vol. 104 (2) 69–71 (1989).

A. Acyl/dialkyl ethylenediamine derivatives (2-alkyl hydroxyethyl imidazoline derivatives) (and salts)

B. N-alkylamino acids (and salts)

2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

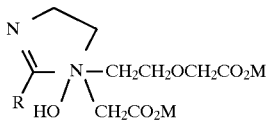

wherein R is an acyclic hydrophobic group containing from about 8 t 18 carbon atoms and M is a cation to neutralize the charge of the anion, generally sodium.

Commercially prominent imidazoline-derived amphoterics include for example:

Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid.

The carboxymethylated compounds (glycinates) listed above frequently are called betaines. Betaines are a special class of amphoteric discussed in the section entitled, Zwitterion Surfactants.

Long chain N-alkylamino acids are readily prepared by reaction $RNH_2$($R=C_8$–$C_{18}$) fatty amines with halogenated carboxylic acids. Alkylation of the primary amino groups of an amino acids leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine.

Examples of commercial N-alkylamino acid ampholytes having application in this invention include alkyl beta-amino dipropionates, $RN(C_2H_4COOM)_2$ and $RNHC_2H_4COOM$. R is an acyclic hydrophobic group containing from about 8 to about 18 carbon atoms, and M is a cation to neutralize the charge of the anion.

Zwitterionic Surfactants

The presence of a positive charged quaternary ammonium or, in some cases, of a sulfonium or phosphonium ion; and of a negative charged carboxyl group within a compound of aliphatic derivative generally of betaine structure:

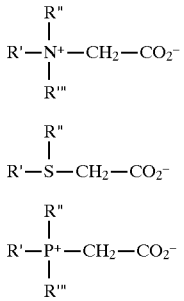

yields an amphoteric of special character termed a zwitterion. These amphoterics contain cationic and anionic groups which ionize to a nearly equal degree in the isoelectric region of the molecule and develop strong "inner-salt" attraction between positive-negative charge centers. As a result, surfactant betaines do not exhibit strong cationic or anionic characters at pH extremes nor do they show reduced water solubility in their isoelectric range. Unlike "external" quaternary ammonium salts, betaines are compatible with anionics.

Zwitterionic synthetic surfactants useful in the present invention can be broadly described as derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. A general formula for these compounds is:

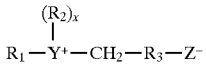

wherein $R_1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R_2$ is an alkyl or monohydroxy alkyl group containing 1 to 3 carbon atoms; x is 1 when Y is a sulfur atom and 2 when Y is a nitrogen or phosphorus atom, $R_3$ is an alkylene or hydroxy alkylene or hydroxy alkylene of from 1 to 4 carbon atoms and Z is a radical selected from the group consisting of caboxylate, sulfonate, sulfate, phosphonate, and phosphate groups.

Examples include:

4-[N,N-di(2-hydroxyethyl)-N-octadecylammonio]-butane-1-carboxylate;

5-[S-3-hydroxypropyl-S-hexadecylsulfonio]-3-hydroxypentane-1-sulfate;

3-[P,P-diethyl-P-3,6,9-trioxatetracosanephosphonio]-2-hydroxypropane-1-phosphate;

3-[N,N-dipropyl-N-3-dodecoxy-2-hydroxypropyl-ammonio]-propane-1-phosphonate;

3-(N,N-dimethyl-N-hexadecylammonio)-propane-1-sulfonate;

3-(N,N-dimethyl-N-hexadecylammonio)-2-hydroxy-propane-1-sulfonate;

4-[N,N-di(2(2-hydroxyethyl)-N(2-hydroxydodecyl) ammonio]-butane-1-carboxylate;

3-[S-ethyl-S-(3-dodecoxy-2-hydroxypropyl)sulfonio]-propane-1-phosphate;

3-[P,P-dimethyl-P-dodecylphosphonio]-propane-1-phosphonate; and

S[N,N-di(3-hydroxypropyl)-N-hexadecylammonio]-2-hydroxy-pentane-1-sulfate.

The alkyl groups contained in said detergent surfactants can be straight or branched and saturated or unsaturated.

The nonionic and anionic surfactants enumerated above can be used singly or in combination in the practice and utility of the present invention. The semi-polar nonionic, cationic, amphoteric and zwitterionic surfactants generally are employed in combination with nonionics or anionics. The above examples are merely specific illustrations of the numerous surfactants which can find application within the scope of this invention. The foregoing organic surfactant compounds can be formulated into any of the several commercially desirable composition forms of this invention having disclosed utility. Said compositions are cleaning treatments for food soiled surfaces in concentrated form which, when dispensed or dissolved in water, properly diluted by a proportionating device, and delivered to the target surfaces as a solution, gel or foam will provide cleaning. Said cleaning treatments consisting of one product; or, involving a two product system wherein proportions of each are utilized. Said product being concentrates of liquid or emulsion; solid, tablet, or encapsulate; powder or particulate; gel or paste; and slurry or mull.

Builders

Builders are substances that augment the detersive effects of detergents or surfactants and supply alkalinity to the cleaning solution. Builders have the detersive properties of promoting the separation of soil from surfaces and keeping detached soil suspended in the detersive solution to retard redeposition. Builders may of themselves be precipitating, sequestrating or dispersing agents for water hardness control; however, the builder effect is independent of its water conditioning properties. Although there is functional overlap, builders and water conditioning agents having utility in this invention will be treated separately.

Builders and builder salts can be inorganic or organic in nature and can be selected from a wide variety of detersive, water soluble, alkaline compounds known in the art.

A. Water soluble inorganic alkaline builder salts which can be used alone in the present invention or in admixture with other builders include, but are not limited to, alkali metal or ammonia or substituted ammonium salts of carbonates, silicates, phosphates and polyphosphates, and borates.

Carbonates useful in the invention include all physical forms of alkali metal, ammonium and substituted ammonium salts of carbonate, bicarbonate and sesquicarbonate (all with or without calcite seeds), in anhydrous or hydrated forms and mixtures thereof.

Silicates useful in the invention include all physical forms of alkali metal salts of crystalline silicates such as ortho-, sesqui- and metasilicate in anhydrous or hydrated form; and, amorphous silicates of higher $SiO_2$ content in liquid or powder state having $Na_2O/SiO_2$ ratios of from about 1.6 to about 3.75; and, mixtures thereof.

Phosphates and polyphosphates useful in the invention include all physical forms of alkali metal, ammonium and substituted ammonium salts of dibasic and tribasic orthophosphate, pyrophosphates, and condensed polyphosphates such as tripolyphosphate, trimetaphosphate and ring open derivatives; and, glassy polymeric metaphosphates of general structure $M_{n+2}P_nO_{3n+1}$ having a degree of polymerization n of from about 6 to about 21 in anhydrous or hydrated forms, and, mixtures thereof.

Borates useful in the invention include all physical forms of alkali metal salts of metaborate and pyroborate (tetraborate, borax) in anhydrous or hydrated forms; and, mixtures thereof.

B. Water soluble organic alkaline builders which are useful in the present invention include alkanolamines and cyclic amines.

Water soluble alkanolamines include those moieties prepared from ammonia and ethylene oxide or propylene oxide; i.e. mono-, di-, and triethanolamine; and, mono-, di-, and triisopropanolamine; and substituted alkanolamines; and, mixtures thereof.

The preferred builder compounds for compositions of the present invention are the water soluble, inorganic alkaline builder salts of carbonates, silicates and phosphates/polyphosphates.

The most preferred builder salts for the most preference compositions of the present invention are the salts of carbonate, bicarbonate and sesquicarbonate; and, mixtures thereof.

Generally, the concentration of builder or builder mixture useful in use-dilution, use solutions of the present invention ranges from about 0% (0 ppm) by weight to about 0.1% (1000 ppm) by weight, preferably from about 0.0025% (25 ppm) by weight to about 0.05% (500 ppm) by weight, and most preferably from about 0.005% (50 ppm) by weight to about 0.025% (250 ppm) by weight.

The concentration of builder or builder mixture useful in the most preferred concentration embodiments of the present invention ranges from about 10% by weight to about 50% by weight of the total formula weight percent of the builder containing composition.

Water Conditioning Agent

Water conditioning agents function to inactivate water hardness and prevent calcium and magnesium ions from interacting with soils, surfactants, carbonate and hydroxide. Water conditioning agents therefore improve detergency and prevent long term effects such as insoluble soil redepositions, mineral scales and mixtures thereof. Water conditioning can be achieved by different mechanisms including sequestration, precipitation, ion-exchange and dispersion (threshold effect).

Metal ions such as calcium and magnesium do not exist in aqueous solution as simple positively charged ions. Because they have a positive charge, they tend to surround themselves with water molecules and become solvated. Other molecules or anionic groups are also capable of being attracted by metallic cations. When these moieties replace water molecules, the resulting metal complexes are called coordination compounds. An atom, ion or molecule that combines with a central metal ion is called a ligand or complexing agent. A type of coordination compound in which a central metal ion is attached by coordinate links to two or more nonmetal atoms of the same molecule is called a chelate. A molecule capable of forming coordination complexes because of its structure and ionic charge is termed a chelating agent. Since the chelating agent is attached to the same metal ion at two or more complexing sites, a heterocyclic ring that includes the metal ions is formed. The binding between the metal ion and the liquid may vary with the reactants; but, whether the binding is ionic, covalent or hydrogen bonding, the function of the ligands is to donate electrons to the metal.

Ligands form both water soluble and water insoluble chelates. When a ligand forms a stable water soluble chelate, the ligand is said to be a sequestering agent and the metal is sequestered. Sequestration therefore, is the phenomenon of typing up metal ions in soluble complexes, thereby preventing the formation of undesirable precipitates. The builder should combine with calcium and magnesium to form soluble, but undissociated complexes that remain in solution in the presence of precipitating anions. Examples of water conditioning agents which employ this mechanism are the condensed phosphates, glassy polyphosphates, phosphonates, amino polyacetates, and hydroxycarboxylic acid salts and derivatives.

Like ligands which inactivate metal ions by precipitation, similar effect is achieved by simple supersaturation of calcium and magnesium salts having low solubility. Typically carbonates and hydroxides achieve water conditioning by precipitation of calcium and magnesium as respective salts. Orthophosphate is another example of a water conditioning agent which precipitates water hardness ions. Once precipitated, the metal ions are inactivated.

Water conditioning can also be affected by an in situ exchange of hardness ions from the detersive water solution to a solid (ion exchanger) incorporated as an ingredient in the detergent. In detergent art, this ion exchanger is an aluminosilicate of amorphoric or crystalline structure and of naturally occurring or synthetic origin commercially designated as zeolite. To function properly, the zeolite must be of small particle size of about 0.1 to about 10 microns in diameter for maximum surface exposure and kinetic ion exchange.

The water conditioning mechanisms of precipitation, sequestration and ion exchange are stoichiometric interactions requiring specific mass action proportions of water conditioner to calcium and magnesium ion concentrations. Certain sequestering agents can further control hardness ions at sub-stoichiometric concentrations. This property is called the "threshold effect" and is explained by an adsorption of the agent onto the active growth sites of the submicroscopic crystal nuclei which are initially produced in the supersaturated hard water solution, i.e., calcium and magnesium salts. This completely prevents crystal growth, or at least delays growth of these crystal nuclei for a long period of time. In addition, threshold agents reduce the agglomeration of crystallites already formed. Compounds which display both sequestering and threshold phenomena with water hardness minerals are much preferred conditioning agents for employ in the present invention. Examples include tripolyphosphate and the glassy polyphosphates, phosphonates, and certain homopolymers and copolymer salts of carboxylic acids. Often these compounds are used in conjunction with the other types of water conditioning agents for enhanced performance. Combinations of water conditioners having different mechanisms of interaction with hardness result in binary, ternary or even more complex conditioning systems providing improved detersive activity.

The water conditioning agents which can be employed in the detergent compositions of the present invention can be inorganic or organic in nature; and, water soluble or water insoluble at use dilution concentrations.

A-1. Inorganic Water Soluble Water Conditioning Agents

Useful examples include all physical forms of alkali metal, ammonium and substituted ammonium salts of carbonate, bicarbonate and sesquicarbonate; pyrophrophates, and condensed polyphosphates such as tripolyphosphate, trimetaphosphate and ring open derivatives; and, glassy polymeric metaphosphates of general structure $M_{n+2}P_nO_{3n+1}$ having a degree of polymerization n of from about 6 to about 21 in anhydrous or hydrated forms; and, mixtures thereof.

A-2. Inorganic Water Insoluble Water Conditioning Agents

Aluminosilicate builders are useful in the present invention. Useful aluminosilicate ion exchange materials are commercially available. These aluminosilicates can be amorphous or crystalline in structure and can be naturally-occurring aluminosilicates or synthetically derived.

Amorphous aluminosilicate builders include those having the empirical formula:

$$N_z(ZAlO_2;ySiO_2)$$

wherein M is a univalent cation such as sodium, potassium, lithium, ammonium or substituted ammonium, z is from about 0.5 to about 2; and y is 1; this material having a magnesium ion exchange capacity of at least about 50 milligram equivalents of $CaCO_3$ hardness per gram of anhydrous aluminosilicate.

Preferred crystalline aluminosilicates are zeolite builders which have the formula:

$$Na_z[AlO_2)_z(SiO_2)_y]xH_2O$$

wherein z and y are integers of at least 6, the molar ratio of z to y is in the range of from 1.0 to about 0.5 and x is an integer from about 15 to about 264. Said aluminosilicate ion-exchange material having a calcium ion exchange capacity on an anhydrous basis of at least about 200 milligrams equivalent of $CaCO_3$ hardness per gram.

Preferred synthetic crystalline aluminosilicate ion exchange materials useful herein are available under the designations zeolite crystal structure group A and X. In an especially preferred embodiment, the crystalline aluminosilicate ion exchange material has the formula:

$$Na_{12}[(AlO_2)_{12}(SiO_2)_{12}]xH_2O$$

wherein x is from about 20 to about 30, especially about 27. This material is known as zeolite A. Preferably, the aluminosilicate has a pore size determined by the unit structure of the zeolite crystal of about 3 to about 10 Angstroms; and, a finely divided mean particle size of about 0.1 to about 10 microns in diameter.

These preferred crystalline types of zeolites are well known in the art and are more particularly described in the text *Zeolite Molecular Sieves*, Breck, D. W., John Wiley and Sons, New York, 1974.

B. Organic Water Soluble Water Conditioning Agents

Organic water soluble water conditioning agents useful in the compositions of the present invention include aminpolyacetates, polyphosphonates, aminopolyphosphonates, short chain carboxylates and a wide variety of polycarboxylate compounds.

Organic water conditioning agents can generally be added to the composition in acid form and neutralized in situ; but, can also be added in the form of a preneutralized salt. When utilized in salt form, alkali metals such as sodium, potassium and lithium; or, substituted ammonium salts such as from mono-, di- or triethanolammonium cations are generally preferred.

B-1. Aminopolyacetates

The water soluble aminopolyacetate compounds have a moiety with the structural formula:

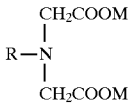

wherein R is selected from

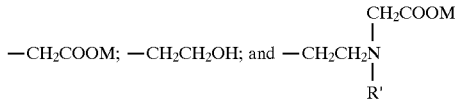

wherein R' is

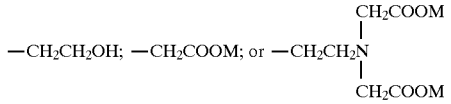

and each M is selected from hydrogen and a salt-forming cation.

Aminopolyacetate water conditioning salts suitable for use herein include the sodium, potassium lithium, ammonium, and substituted ammonium salts of the following acids:

ethylenediaminetetraacetic acid, N-(2-hydroxyethyl)-ethylenediamine triacetic acid, N-(2-hydroxyethyl)-nitrilodiacetic acid, diethylenetriaminepentaacetic acid, 1,2-diaminocyclohexanetetracetic acid and nitrilotriacetic acid; and, mixtures thereof.

B-2. Polyphosphonates

Polyphosphonates useful herein specifically include the sodium, lithium and potassium salts of ethylene diphosphonic acid; sodium, lithium and potassium salts of ethane-1-hydroxy-1,1-diphosphonic acid and sodium lithium, potassium, ammonium and substituted ammonium salts of ethane-2-carboxy-1,1-diphosphonic acid, hydroxymethane-diphosphonic acid, carbonyldiphosphonic acid, ethane-1-hydroxy-1,1,2-triphosphonic acid, ethane-2-hydroxy-1,1,2-triphosphonic acid, propane-1,1,3,3-tetraphosphonic acid propane-1,1,2,3-tetraphophonic acid and propane 1,2,2,3-tetraphosphonic acid; and mixtures thereof. Examples of these polyphosphonic compounds are disclosed in British Pat. No. 1,026,366. For more examples see U.s. Pat. No. 3,213,030 to Diehl issued Oct. 19, 1965 and U.S. Pat. No. 2,599,807 to Bersworth issued Jun. 10, 1952.

B-3. Aminopolyphosphonates

The water soluble aminopolyphosphonate compounds have the structural formula:

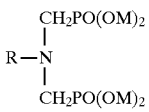

wherein R is selected from:

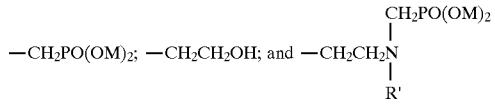

wherein R' is

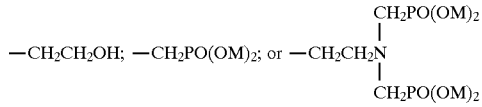

and each M is selected from hydrogen and a salt forming cation.

Aminopolyphosphonate compounds are excellent water conditioning agents and may be advantageously used in the present invention. Suitable examples include soluble salts, e.g. sodium, lithium or potassium salts, of diethylene thiamine pentamethylene phosphonic acid, ethylene diamine tetramethylene phosphonic acid, hexamethylenediamine tetramethylene phosphonic acid, and nitrilotrimethylene phosphonic acid; and, mixtures thereof.

B-4. Short Chain Carboxylates

Water soluble short chain carboxylic acid salts constitute another class of water conditioner for use herein. Examples include citric acid, gluconic acid and phytic acid. Preferred salts are prepared from alkali metal ions such as sodium, potassium, lithium and from ammonium and substituted ammonium.

B-5. Polycarboxylates

Suitable water soluble polycarboxylate water conditioners for this invention include the various ether polycarboxylates, polyacetal, polycarboxylates, epoxy polycarboxylates, and aliphatic-, cycloalkane- and aromatic polycarboxylates.

Water soluble ether polycarboxylic acids or salts thereof useful in this invention have the formula:

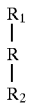

wherein $R_1$ is selected from —$CH_2COOM$; —$CH_2CH_2COOM$;

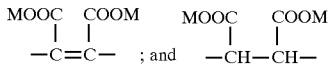

and $R_2$ is selected from —$CH_2COOM$; —$CH_2CH_2COOM$;

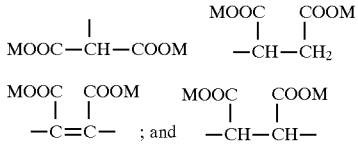

wherein $R_1$ and $R_2$ form a closed ring structure in the event said moieties are from:

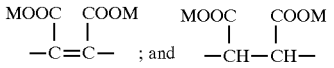

each M is selected from hydrogen and a salt forming cation. The salt forming cation M can be represented, for example, by alkali metal cations such as potassium, lithium and sodium and also by ammonium and ammonium derivatives. Specific examples of this class of carboxylate builder include the water soluble salts of oxydiacetic acid and, for example, oxydisuccinic acid, carboxyl methyl oxysuccinic acid, furan tetra carboxylic acid and tetrahydrofuran tetracarboxylic acid. Greater detail is disclosed in U.S. Pat. No. 3,635,830 to Lamberti et al. issued Jan. 18, 1972, incorporated herein by reference. Water soluble polyacetal carboxylic acids or salts thereof which are useful herein as water conditioners are generally described in U.S. Pat. No. 4,144,226 to Crutchfield et al. issued Mar. 13, 1979 and U.S. Pat. No. 4,315,092 to Crutchfield et al. issued Feb. 9, 1982.

A typical product will be of the formula:

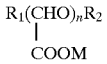

wherein M is selected from the group consisting of alkali metal, ammonium, alkyl groups of 1 to 4 carbon atoms, tetraalkylammonium groups and alkanolamine groups, both of 1 to 4 carbon atoms in the alkyls thereof, n averages at least 4, and $R_1$ and $R_2$ are any chemically stable groups which stabilize the polymer against rapid depolymerization in alkaline solution. Preferably the polyacetal carboxylate will be one wherein M is alkali metal, e.g., sodium, n is from 50 to 200, $R_1$ is

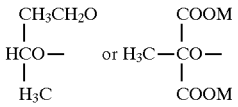

or a mixture thereof, $R_2$ is

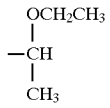

and n averages from 20 to 100, more preferably 30 to 80. The calculated weight average molecular weights of the polymers will normally be within the range of 2,000 to 20,000, preferably 3,500 to 10,000 and more preferably 5,000 to 9,000, e.g., about 8,000.

Water soluble polymeric aliphatic carboxylic acids and salts preferred for application are compositions of this invention are selected from the groups consisting of:

(a) a water soluble salts of homopolymers of aliphatic polycarboxylic acids having the following empirical formula:

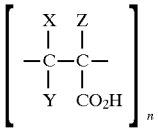

wherein X, Y, and Z are each selected from the group consisting of hydrogen methyl, carboxyl, and carboxymethyl, at least one of X, Y, and Z being selected from the group consisting of carboxyl and carboxymethyl, provided that X and Y can be carboxymethyl only when Z is selected from carboxyl and carboxymethyl, wherein only one of X, Y, and Z can be methyl, and wherein n is a whole integer having a value within a range, the lower limit of which is three and the upper limit of which is determined by the solubility characteristics in an aqueous system;

(b) water soluble salts of copolymers of at least two of the monomeric species having the empirical formula described in (a), and (c) water soluble salts of copolymers of a member selected from the group of alkylenes and monocarboxylic acids with the aliphatic polycarboxylic compounds described in (a), said copolymers having the general formula:

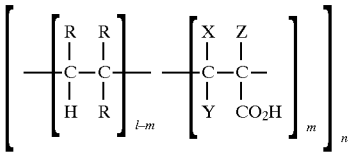

wherein R is selected from the group consisting of hydrogen, methyl, carboxyl, carboxymethyl, and carboxyethyl; wherein only one R can be methyl; wherein m is at least 45 mole percent of the copolymer; wherein X, Y, and Z are each selected from the group consisting of hydrogen, methyl, carboxyl, and carboxymethyl; at least one of X, Y, and Z being selected from the group of carboxyl and carboxymethyl provided that X and Y can be carboxymethyl only when Z is selected from group of carboxyl and carboxymethyl, wherein only one of X, Y, and Z can be methyl and wherein n is a whole integer within a range, the lower limit of which is three and the upper limit of which is determined primarily by the solubility characteristics in an aqueous system; said polyelectrolyte builder material having a minimum molecular weight of 350 calculated as the acid form and an equivalent weight of about 50 to about 80, calculated as the acid form (e.g., polymers of itaconic acid acrylic acid maleic acid; aconitic acid; mesaconic acid; fumaric acid; methylene malonic acid; and citraconic acid and copolymers with themselves and other compatible monomers containing no carboxylate radicals such as ethylene, styrene and vinylmethyl ether). These polycarboxylate builder salts are more specifically described in U.S. Pat. No. 3,308,067 to Diehl issued Mar. 7, 1967; incorporated herein by reference.

The most preferred water conditioner for use in the most preferred embodiments of this invention are water soluble polymers of acrylic acid, acrylic acid copolymers; and derivatives and salts thereof having the empirical formula:

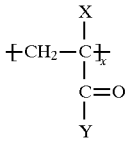

where X=H, $CH_3$Y=$NH_2$, OH, $OCH_3$, $OC_2H_5$, O-$Na^+$, etc. or copolymers with compatible monomers.

Such polymers include polyacrylic acid, polymethacrylic acid, acrylic acid-methacrylic acid copolymers, hydrolyzed polyacrylamide, hydrolyzed polymethacrylamide, hydrolyzed acrylamidemethacrylamide copolymers, hydrolyzed polyacrylonitrile, hydrolyzed polymethacrylonitrile, hydrolyzed acrylonitrilemethacrylonitrile copolymers, or mixtures thereof. Water soluble salts or partial salts of these polymers such as the respective alkali metal (e.g. sodium, lithium potassium) or ammonium and ammonium derivative salts can also be used. The weight average molecular weight of the polymers is from about 500 to about 15,000 and is preferably within the range of from 750 to 10,000. Preferred polymers include polyacrylic acid, the partial sodium salt of polyacrylic acid or sodium polyacrylate having weight average molecular weights within the range of 1,000 to 5,000 or 6,000. These polymers are commercially available, and methods for their preparation are well-known in the art.

For example, commercially available polyacrylate solutions useful in the present cleaning compositions include the sodium polyacrylate solution, Colloid® 207 (Colloids, Inc., Newark, N.J.); the polyacrylic acid solution, Aquatreat® AR-602-A (Alco Chemical Corp., Chattanooga, Tenn.); the polyacrylic acid solutions (50–65% solids) and the sodium polyacrylate powers (M.W. 2,100 and 6,000) and solutions (45% solids) available as the Goodrite® K-700 series from B. F. Goodrich Co.; and the sodium or partial sodium salts of polyacrylic acid solutions (M.W. 1000 to 4500) available as the Acusol® series from Rohm and Haas.

Of course combinations and admixtures of any of the above enumerated water conditioning agents may be advantageously utilized within the embodiments of the present invention.

Generally, the concentration of water or conditioner mixture useful in use dilution, solutions of the present invention ranges from about 0.0005% (5 ppm) by active weight to about 0.04% (400 ppm) by active weight, preferably from about 0.001% (10 ppm) by active weight to about 0.03% (300 ppm) by active weight, and most preferably from about 0.002% (20 ppm) by weight to about 0.02% (200 ppm) by active weight.

The concentration of water or conditioner mixture useful in the most preferred concentrated embodiment of the present invention ranges from about 1.0% by active weight to about 35% by active weight of the total formula weight percent of the builder containing composition.

OPTIONAL ADJUVANTS

In addition, various other additives or adjuvants may be present in compositions of the present invention to provide additional desired properties, either of form, functional or aesthetic nature, for example:

a) Solubilizing intermediaries called hydrotropes can be present in the compositions of the invention of such as xylene-, toluene-, or cumene sulfonate; or n-octane sulfonate; or their sodium-, potassium- or ammonium salts or as salts of organic ammonium bases. Also commonly used are polyols containing only carbon, hydrogen and oxygen atoms. They preferably contain from about 2 to about 6 carbon atoms and from about 2 to about 6 hydroxy groups. Examples include 1,2-propanediol, 1,2-butanediol, hexylene glycol, glycerol, sorbitol, mannitol, and glucose.

b) Nonaqueous liquid carrier or solvents can be used for varying compositions of the present invention. These include the higher glycols, polyglycols, polyoxides and glycol ethers. Suitable substances are propylene glycol, polyethylene glycol, polypropylene glycol, diethylene glycol monoethyl ether, diethylene glycol monopropyl ether, diethylene glycol monobutyl ether, tripropylene glycol methyl ether, propylene glycol methyl ether (PM), dipropylene glycol methyl ether (DPM), propylene glycol methyl ether acetate (PMA), dipropylene glycol methyl ether acetate (CPMA), ethylene glycol n-butyl ether and ethylene glycol n-propyl ether.

Other useful solvents are ethylene oxide/propylene oxide, liquid random copolymer such as Synalox® solvent series from Dow Chemical (e.g., Synalox® 50-50B). Other suitable solvents are propylene glycol ethers such as PnB, DpnB and TpnB (propylene glycol mono n-butyl ether, dipropylene glycol and tripropylene glycol mono n-butyl ethers sold by Dow Chemical under the trade name Dowanol®. Also tripropylene glycol mono methyl ether "TPM Dowanol®" from Dow Chemical is suitable.

c) Viscosity modifiers may be added to the invention. These may include natural polysaccharides such as xanthan gum, carrageenan and the like; or cellulosic type thickeners such as carboxymethyl cellulose, and hydroxymethyl-, hydroxyethyl-, and hydroxypropyl cellulose; or, polycarboxylate thickeners such as high molecular weight polyacrylates or carboxyvinyl polymers and copolymers; or, naturally occurring and synthetic clays; and finely divided fumed or precipitated silica, to list a few.

d) Solidifiers are necessary to prepare solid form compositions of the invention. These could include any organic or inorganic solid compound having a neutral inert character or making a functional, stabilizing or detersive contribution to the intended embodiment. Examples are polyethylene glycols or polypropylene glycols having molecular weight of from about 1,400 to about 30,000; and urea.

A wide variety of other ingredients useful in detergent compositions can be included in the compositions hereof, including other active ingredients, carriers, draining promoting agents, manufacturing processing aids, corrosion inhibitors, antimicrobial preserving agents, buffers, tracers inert fillers, dyes, etc.

The list of optional ingredients above is not intended to be exhaustive and other optional ingredients which may not be listed, but which are well known in the art may also be included in the composition. The examples are not intended to be limiting in any way. In certain cases, some of the individual adjuncts may overlap in other categories.

In general, the total proportion of adjuvants will normally be no more than 40% by weight of the product and desirably will be less than 30% by weight thereof, more desirably less than 30% thereof. Of course, the adjuvants employed will be selected so as not to interfere with the detersive action of the composition and to avoid instability of the product.

TABLE NO. 1

WORKING EXAMPLE NOS. 1–10
ENZYME/BUILDER DUAL COMPONENT CIP (TWO PART) FORMULATIONS FOR PRODUCT LINE

PART 1

| ENZYME/SURFACTANT COMPONENT RAW MATERIAL | Example 1 Percent | Example 2 Percent | Example 3 Percent | Example 4 Percent | Example 5 Percent | Example 6 Percent |
|---|---|---|---|---|---|---|
| Deionized Water | 33.500 | 33.500 | 33.875 | 33.875 | 22.500 | 22.500 |
| Triethanolamine, 99% | 2.000 | 2.000 | 2.000 | 2.000 | 2.000 | 2.000 |
| Sodium Metabisulfite | 1.000 | 1.000 | 1.000 | 1.000 | 1.000 | 1.000 |
| Propylene Glycol | 12.250 | 12.250 | 15.000 | 15.000 | 12.000 | 12.000 |
| Sodium Xylene Sulfonate, 40% | 20.000 | 20.000 | 20.000 | 20.000 | 25.000 | 25.000 |
| Surfonic ® N95 + 5PO* | 25.000 | 25.000 | 25.000 | 25.000 | 25.000 | 25.000 |
| Purafect ® 4000-L, protease** | 6.250 | | 3.125 | | 12.500 | |
| Esperase 8.0L, protease*** | | 6.250 | | 3.125 | | 12.500 |

PART 2

| BUILDER COMPONENT RAW MATERIAL | Example 7 Percent | Example 8 Percent | Example 9 Percent | Example 10 Percent |
|---|---|---|---|---|
| Deionized Water | 61.24 | 57.30 | 47.80 | 67.30 |
| Tetrasodium EDTA, 40% | 0.20 | 0.20 | 0.20 | 0.20 |
| Acusol ®445N**** | 26.00 | 26.00 | 26.00 | 26.00 |
| Sodium Carbonate | 12.56 | 8.25 | | 6.50 |
| Potassium Carbonate | | 8.25 | 26.00 | |

*Surfonic ® N95 + 5PO is manufactured by Texaco Chemical Company
**Purafect ® 4000-L, is manufactured by Genencor International, USA
***Esperase ®8.0L is manufactured by Novo Industri AS, Denmark
****Acusol ®445N is manufactured by Rohm and Haas Company

TABLE NO. 2

WORKING EXAMPLE NOS. 1–10
ENZYME/BUILDER DUAL COMPONENT (TWO PART) CIP PRODUCT LINE

PART 1

| EXAMPLE PRODUCT | PRODUCT DESCRIPTION ENZYME/SURFACTANT | PRODUCT USE CONCENTRATION (PPM) | ENZYME | (%) | (PPM) | SURFACTANT (%) | SURFACTANT (PPM) |
|---|---|---|---|---|---|---|---|
| 1 | Low Temp[1]; "Balanced" Components | 400 | GENENCOR PURAFECT ®4000L | 12.50 | 50 | 25.00 | 100 |
| 2 | Low Temp; Enzyme Rich | 400 | GENENCOR PURAFECT ®4000L | 12.50 | 50 | 25.00 | 100 |
| 3 | Low Temp; Surfactant Rich | 800 | GENENCOR PURAFECT ®4000L | 3.12 | 25 | 25.00 | 200 |
| 4 | High Temp[2]; "Balanced" Components | 400 | NOVO ESPERASE ® 8.0L | 6.25 | 25 | 25.00 | 100 |
| 5 | High Temp; Enzyme Rich | 400 | NOVO ESPERASE ® 8.0L | 12.50 | 50 | 25.00 | 100 |
| 6 | High Temp; Surfactant Rich | 800 | NOVO ESPERASE ® 8.0L | 3.12 | 25 | 25.00 | 200 |

PART 2

| EXAMPLE PRODUCT | PRODUCT DESCRIPTION BUILDER | USE CONCENTRATION (PPM) | CARBONATE SOURCE | (%) | (PPM) total | PAA (%) | PAA (PPM) 100% active |
|---|---|---|---|---|---|---|---|
| 7 | Standard Product | 500 | $NaCO_3/K_2CO_3$ | 8.25/8.25 | 83 | 26.00 | 59 |
| 8 | Soft Water | 250 | $K_2CO_3$ | 26.00 | 65 | 26.00 | 29 |
| 9 | Hard Water | 1000 | $Na_2CO_3$ | 6.50 | 65 | 26.00 | 117 |

TABLE NO. 2-continued

| WORKING EXAMPLE NOS. 1–10 ENZYME/BUILDER DUAL COMPONENT (TWO PART) CIP PRODUCT LINE | | | | | | | |
|---|---|---|---|---|---|---|---|
| 10 | Carbonate Rich; Difficult Soil | 500 | $K_2CO_3$ | 26.00 | 130 | 26.00 | 59 |

[1]Use temperature 30° C. to 65° C.
[2]Use temperature 50° C. to 85° C.

Tables 1 and 2 contain details pertaining to a "family" of two component enzyme/builder products for CIP application. The CIP Product Line is described by product design (i.e. low temp:enzyme rich) and by product application (i.e. soft water). Basically this "family" of products involves three products for low temperature CIP applications (from about 30° C. to about 65° C.); and, three products for high temperature CIP applications (from about 50° C. to about 85° C.). Within each temperature category, products containing a "balanced" ratio of enzyme/surfactant (25 ppm/100 ppm), an enzyme rich ratio of enzyme/surfactant (50 ppm/100 ppm), and a surfactant rich ratio of enzyme/surfactant (25 ppm/200 ppm) are incorporated. The low temperature and high temperature designations reflect one major change within the composition—that change being alkaline protease enzyme. All other ingredients remain unchanged with exception of concentration.

TABLE 3

WORKING EXAMPLE NO. 11
ENZYME/SURFACTANT SOLID CAST (ONE PART) CIP PRODUCTS WITH CARBONATE BUILDER
PREFERRED LIQUID PRODUCT
INGREDIENT PPM USE LEVELS

| RAW MATERIAL | Example 11 USE CONCENTRATION: 0.10% (PPM) |
|---|---|
| Esperase ®8.0L, protease* | 25 |
| Triton ® CF-21** | 100 |
| Acusol ®445N*** | 130 |
| $Na_2CO_3$**** | 63 |

WORKING EXAMPLE NOS. 12–19
SOLID PRODUCTS
INGREDIENT PPM USE LEVELS TO EQUAL PREFERRED LIQUID

| RAW MATERIAL | USE CONCENTRATION: 0.10% (PPM) (NEEDED) | Example 12 CONCENTRATION FACTOR 1X (%) | Example 13 2X (%) | Example 14 3X (%) | Example 15 3.5X (%) |
|---|---|---|---|---|---|
| Esperase ®6.0T, protease* | 19 | 1.9 | 3.8 | 5.7 | 6.7 |
| Triton ®CF-21 | 100 | 10.0 | 20.0 | 30.0 | 35.0 |
| Goodrite ®K-7058D**** | 65 | 6.5 | 13.0 | 19.5 | 22.8 |
| Sodium Carbonate | 63 | 6.3 | 12.6 | 18.9 | 22.1 |
| Polyethylene Glycol 8000 | | 75.3 | 50.6 | 25.9 | 13.4 |
| | USE CONCENTRATION | 0.100% | 0.050% | 0.033% | 0.029% |
| | PPM | 1000 | 500 | 333 | 290 |

SOLID PRODUCT FORMULATIONS
CONCENTRATION 3X PREFERRED

| RAW MATERIAL | Example 16 PERCENT | Example 17 PERCENT | Example 18 PERCENT | Example 19 PERCENT |
|---|---|---|---|---|
| Esperase ®6.0T, protease | 5.60 | 5.60 | | |
| Triton ®CF-21 | 30.00 | 30.00 | 30.00 | 30.00 |
| Goodrite ®K-7058D | 19.60 | 19.60 | 19.00 | 18.70 |
| Sodium Carbonate | 29.80 | 18.80 | 18.80 | 18.80 |
| Polyethylene Glycol 8000 | 15.00 | 26.00 | 26.00 | 26.00 |

TABLE 3-continued

| | | |
|---|---|---|
| PROTECT 76-10***** | 6.20 | |
| PROTECT 76-15***** | | 6.50 |

*Esperase ®8.0L and Esperase 6.0T are manufactured by Novo Industri AS, Denmark.
**Triton ®CF-21 is manufactured by Union Carbide Chemical & Plastics Company.
***Acusol ®445N is manufactured by Rohm and Haas Company.
****Goodrite ®K-7058D is manufactured by BF Goodrich Chemical Division.
*****Protect 76-10 and Protect 76-15 are encapsulates of Esperase ®6.0T having 10% and 15% by weight encapsulated coatings comprising sodium polyacrylate, 4500 molecular weight, Table 3 represents another product form of the invention, i.e. a cast solid. Table 3 shows various Concentration (ppm) levels of ingredients which are delivered in detersive solutions by the preferred liquid dual component system, then illustrates suggested compositions which would deliver the same ppm levels at various concentration factors, and then lists several solid compositions actually prepared. Changes are made in raw material selection, such as using anhydrous polyacrylate water conditioner and prilled enzyme, to facilitate formulation. However, the biggest formulary change is the necessary inclusion of a solidifier, polyethylene glycol 8000, for product form. Also disclosed in these compositions is the concept of encapsulated enzyme for improved stability-especially needed during the hot melt/pour cast manufacturing process.

TABLE 4

WORKING EXAMPLE NO. 20
ENZYME/SURFACTANT SOLID CAST (ONE PART) CIP PRODUCTS WITH SILICATE BUILDER

PREFERRED LIQUID PRODUCT INGREDIENT PPM USE LEVELS

| RAW MATERIAL | Example 20 USE CONCENTRATION: 0.10% (PPM) |
|---|---|
| Esperase ®8.0L, protease* | 25 |
| Triton ®CF-21** | 100 |
| Acusol ®445N*** | 130 |
| E SILICATE**** | 400 |

SOLID PRODUCT FORMULATIONS PREPARED CONCENTRATION 3X PREFERRED LIQUID

| RAW MATERIAL | Example 24 2.5X RB-9143-9 PERCENT | Example 26 3.0X RB-9143-9 PERCENT |
|---|---|---|
| Esperase ®6.0T, protease | 4.80 | 5.70 |
| Triton ®CF-21 | 25.00 | 30.00 |
| Acusol ®445N | 16.30 | 16.30 |
| SS 20 ®PWD | 33.90 | 28.00 |
| Polyethylene Glycol 8000 | 20.00 | 20.00 |

*Esperase ®8.0L and Esperase 6.0T are manufactured by Novo Industri AS, Denmark.
**Triton ®CF-21 is manufactured by Union Carbide Chemical & Plastics Company.
***Acusol ®445N is manufactured by Rohm and Haas Company.
****E Silicate is a liquid 36% 3.22 $SiO_2/Na_2O$ silicate manufactured by PQ Corp.
*****SS 20 Pwd is an anhydrous 98% 3.22 $SiO_2/Na_2O$ silicate manufactured by PQ Corp.

Like the enzyme/surfactant solid cast CIP products with carbonate builder, this table illustrates that a solid form of product can be developed having a silicate builder. The table is laid out in similar fashion with a comparison made to a liquid (ppms delivered) formula, followed by prophetic solid formulas, and then concluded with actual solid formulations prepared.

TABLE NO. 5

WORKING EXAMPLE NOS. 26–30
ALTERNATE ENZYME/BUILDER DUAL COMPONENT FORMULATION EXAMPLES

| ENZYME/ SUR-FACTANT COMPONENT RAW MATERIAL | Example 26 PERCENT | Example 27 PERCENT | Example 28 PERCENT | Example 29 PERCENT |
|---|---|---|---|---|
| Exper-ase ®8.0L, protease*** | 20.00 | 19.00 | 33.30 | 31.70 |
| Triethanol-amine, 99% | | 2.00 | | 2.000 |
| Sodium Metabisulfite | | 1.00 | | 1.000 |
| Propylene Glycol | | 2.00 | | 2.00 |
| Triton ® CF-21*** | 80.000 | 76.00 | 66.70 | 63.30 |
| USE CON-CENTRATION | 0.0125% | 0.0130% | 0.0150% | 0.0155% |
| PPM | 1225 | 130 | 150 | 155 |

| BUILDER COMPONENT** RAW MATERIAL | EXAMPLE 30 PERCENT |
|---|---|
| Soft Water | 47.00 |
| Acusol ®445N***** | 13.00 |
| E Silicate ®****** | 40.00 |
| USE CONCENTRATION | 0.10% |
| PPM | 1000 |

*High concentrate.
**Liquid silicate builder used in all Examples.
***Esperase ®8.0L is manufactured by Novo Industri AS, Denmark.
****Triton ®CF-21 is manufactured by Union Carbide Chemical & Plastics Company.
*****Acusol ®445N is manufactured by Rohm and Haas Company.
******E Silicate ®is a liquid 36% 3.22 $SiO_2/Na_2O$ silicate manufactured by PQ Corp.
Table 5 is included to show that the enzyme/surfactant component of the dual products system can be formulated to a very high active concentration, in fact excluding addition of water. Liquid enzymes may contain water as purchased, consequently, the formulator can either include or exclude the axillary stabilizing system. In addition, the builder component contains, in table 5, a silicate as the builder rather than carbonate

TABLE NO. 6

WORKING EXAMPLE NOS. 31–34
ENZYME/SURFACTANT GRANULATED CIP PRODUCTS*

| RAW MATERIAL | Example 31 PERCENT | Example 32 PERCENT | Example 33 PERCENT | Example 34 PERCENT |
|---|---|---|---|---|
| Sodium Carbonate | 56.00 | 51.50 | 56.00 | 51.50 |
| Sodium Tripolyphosphate | 25.00 | 25.00 | 25.00 | 25.00 |
| Triethanolamine, 99% | | 2.00 | | 2.00 |
| Sodium Metabisulfite | | 1.00 | | 1.00 |
| Propylene Glycol | | 2.00 | | 2.00 |
| Surfonic ® N95 + 5PO | 10.00 | 10.00 | 10.00 | 10.00 |
| Purafect ®4000-G, protease*** | 2.50 | 2.50 | | |
| Maxacal ®CST 450,000, protease**** | | | 2.50 | 2.50 |
| Goodrite ®K-7058D***** | 6.00 | 6.00 | 6.00 | 6.00 |

*Experimental formulas w/wo "Stabilizing Systems" for use--dilution effect. Expected use-dilution 0.1% (1000 ppm).
**Surfonic ® N95 + 5PO is manufactured by Texaco Chemical Company.
***Purafect 4000-G is manufactured by Genencor International, USA.
****Maxacal CXT 450,000 is manufactured by Gist-Brocase International, NV.
*****Goodrite K-7058D is manufactured by BF Goodrich Chemical Division.

Table 6 illustrates examples of anhydrous granulate enzyme/builder/surfactant compositions. These are single component formulations that show the basic technology lends itself to this product form. STPP is the choice of water conditioning agent in these particular compositions. Prilled enzymes are utilized because of product form. Because these concentrates are anhydrous, it is the formulator's choice if a stabilizing system is included for use-dilution effect rather than a need for facilitating shelf-life.

CLEANING OF SOILED SS PANELS

Cleaning performance evaluations of the particularly preferred concentrate embodiment of this invention—a two part, two product detergent system.

1) The Stainless Steel 304 panels used in this cleaning evaluation were prepared/soiled according to Ecolab RB No. 9419-3,4

TABLE A

| SS PANEL | CLEANING SOLUTION | CLEANING TEMPERATURE | CLEANING TIME | WHOLE MILK SOIL | WI (After Soiling) | WI (After Cleaning) | PERCENT CLEANING |
|---|---|---|---|---|---|---|---|
| (2) | (A) | 50° C. | 15 min. | — | 7.82 | 18.49 | 136.45 |
| (1) | (A) | 50° C. | 15 min. | 0.25% | 10.42 | 19.40 | 86.19 |
| (9) | (A) | 65° C. | 15 min. | — | 8.42 | 9.50 | 12.83 |
| (3) | (B) | 50° C. | 15 min. | — | 7.80 | 6.67 | −14.49 |
| (11) | (B) | 65° C. | 15 min. | — | 8.11 | 6.81 | −16.03 |
| (4) | (C) | 50° C. | 15 min. | — | 8.12 | 23.78 | 192.86 |
| (10) | (C) | 50° C. | 15 min. | 0.25% | 9.00 | 25.62 | 184.67 |
| (12) | (C) | 65° C. | 15 min. | — | 8.06 | 21.86 | 171.22 |
| (21) | (C) | 65° C. | 15 min. | 0.25% | 9.11 | 23.30 | 155.77 |
| (5) | (D) | 50° C. | 15 min. | — | 8.17 | 18.31 | 124.11 |
| (13) | (D) | 50° C. | 15 min. | 0.25% | 9.90 | 22.49 | 127.26 |
| (24) | (D) | 65° C. | 15 min. | — | 7.96 | 7.96 | 0.00 |
| (6) | (E) | 50° C. | 15 min. | — | 7.55 | 28.43 | 276.56 |
| (20) | (E) | 50° C. | 15 min. | 0.25% | 10.67 | 30.49 | 185.67 |
| (25) | (E) | 65° C. | 15 min. | — | 8.26 | 25.97 | 214.41 |
| (22) | (E) | 65° C. | 15 min. | 0.25% | 8.77 | 29.28 | 233.74 |
| (26) | (F) | 65° C. | 15 min. | — | 8.33 | 18.22 | 118.73 |
| (23) | (F) | 65° C. | 15 min. | 0.25% | 8.57 | 10.28 | 19.93 |
| (41) | (F) | 75° C. | 15 min. | — | 10.24 | 21.79 | 112.85 |
| (8) | (G) | 50° C. | 15 min. | — | 8.08 | 6.56 | 18.81 |
| (2) | (A) | 50° C. | 15 min. | — | 7.82 | 18.49 | 136.45 |
| (30) | (G) | 65° C. | 15 min. | — | 7.67 | 6.95 | −9.39 |
| (34) | (H) | 65° C. | 15 min. | — | 11.52 | 19.90 | 72.78 |
| (32) | (H) | 75° C. | 15 min. | — | 9.61 | 14.87 | 54.68 |
| (14) | (I) | 65° C. | 15 min. | — | 12.11 | 25.30 | 108.93 |
| (33) | (I) | 75° C. | 15 min. | — | 9.71 | 25.99 | 167.75 |
| (29) | (J) | 65° C. | 15 min. | — | 10.24 | 23.89 | 133.25 |
| (31) | (K) | 65° C. | 15 min. | — | 9.07 | 28.58 | 215.23 |
| (40) | (K) | 75° C. | 15 min. | — | 10.12 | 21.77 | 115.19 |

PROCEDURE FOR PROTEIN SOILING AND CLEANING OF STAINLESS STEEL PANELS

Purpose: To simulate the soiling and subsequent cleaning of stainless steel equipment surfaces in dairy plants and farms The following reagents and test materials should be aprepared and/or obtained prior to conducting soiling and cleaning procedure:

1) 3"×5"304 stainless steel panels with #4 finish having two ¼" holes drilled at top and numbered.
2) 3/16" stainless steel rods approx. 15"in length.
3) ⅛" and ¼" I.D. rubber tubing cut into ¼" lengths.
4) 10.5 liter tank with heating and circulation capabilities.
5) 22.2 liter tank with drain cock.
6) A consumer type automatic dishwasher.
7) HunterLab UltraScan Spectrophotometer Model US-8000.
8) Lab Magnetic stir plate with heating capabilities.
9) 1000 ml. beakers.
10) Magnetic stir bars.
11) Lab thermometer.
12) Graduated cylinders and Volumetric pipettes.
13) KLENZ SOLV (a Klenzade liquid detergent-solvent product).
14) FOAM BREAKER (a Klenzade general defoaming product).
15) AC-300 (a Klenzade conventional acid CIP detergent).
16) PRINCIPAL without chlorine (a Klenzade conventional high alkaline CIP detergent prepared without hyppochlorite).
17) Cleaning solutions to be evaluated.
18) Hardness solution (110.2 g/L $CaCl_2$* 2 $H_2O$ and 84.6 g/L $MgCl_2$* 6 $H_2O$).
19) 60 gallons of Whole Milk (commercial Homogenized).

Conditioning of SS Panels Prior to Soiling and Cleaninq

1) Clean SS panels with 3% by volume of Klenz Solv and 1.5% by volume of Foam Breaker in 10.5 liter tank at 135° F. for 45 min. Remove panels and rinse both panels and tank with distilled water.
2) Passivate the SS panels with 54% by volume of AC-300 in 10.5 liter tank at 135° F. for 1 hour.
3) Remove panels, rinse well with distilled water and allow to air dry.
4) Measure Whiteness Index (panel before soiling) of test panels by means of the HunterLab UltraScan Spectrophotometer, Model US-8000. The operating procedure for the UltraScan is found in the manufacturers manual.

Soiling of SS Panels

1) Fill the 22.2 L tank with 6 gallons of milk.
2) Place SS panels on SS rods with ¼" rubber tube spacers between each panel and a piece of ⅛" rubber tube on each end to hold panels in place. Approx. 21 panels will fit on the 15" rods.
3) Place the rack of SS panels into the tank of milk.
4) Slowly drain the milk from the tank at a flow rate of approx. 150 ml\min. Collect the milk to be used a second time.
5) After the level of milk in the tank is below the outlet, remove the rack of panels and place securely in bottom of consumer dishwater.
6) Using a wash temperature of approx. 100° F., wash the rack of panels for 2 min. in dishwasher with a solution containing 2500 ppm PRINCIPAL without chlorine, 60 ppm Ca and 20 ppm Mg. For a 10 liter machine add 25 ml PRINCIPAL and 20 ml Hardness soln. listed above.
7) Following the wash, rinse the panels for 1.5–2 min. using city water wihout machine drying.
8) Remove rack of panels and allow to air dry approx. 30 min. at RT prior to repeating the above seven steps for a total of 20 cycles.
9) Fresh milk should be used every other cycle with a total of 60 gallons of milk used.

Cleaning of Soiled SS Panels

Dipping Test

1) Prepare the cleaning solutions in City water using 1000 ml beakers.
2) Place one soiled panel in bottom of beaker filled iwth 1000 ml of desired cleaning solution that has been preheated to desired temperature. Agitate solution for desired time by means of a heating, magnetic stir place and magnetic stir bar.
3) After cleaning, rinse panels with DI water and allow to air dry.
4) Measure Whiteness Index (panel after soiling) of test panels.
5) Percent change (cleaning) is calculated by the formula WI (panel after cleaning)-WI (panel after soiling)/WI (panel after soiling). WI=Whiteness Index.
6) Percent soil removal is calculated by the formula WI (panel after cleaning)-WI (panel after soiling)/WI (panel before soiling)-WI (panel after soiling).
7) Whiteness Index (WI) measurement is per ASTM E313 (see ASTM E313-73 (Reapproved 1987)

| 2) The following cleaning solutions were prepared in 60 ppm City water: | pH before Milk | pH after Milk |
|---|---|---|
| (A) 25 ppm Purafect 4000-L (0.050 gm/2000 ml) | 8.67 | 7.69 |
| (B) 0.05% Product A (1.00 gm/2000 ml) or 1 oz./15.6 gal. | 10.00 | — |
| (C) 0.04% Product B with Purafect 4000-L (0.80 gm/2000 ml) or 1 oz./19.5 gal. | 8.50 | 7.69 |
| (D) 25 ppm Purafect 4000-L (0.50 gm/2000 ml) & 0.05% Product A (1.00 gm/2000 ml). | 9.95 | 9.54 |
| (E) 0.05% Product A (1.00 gm/2000 ml) & 0.04% Product B with Purafect 4000-L (0.80 gm/2000 ml) | 9.86 | 9.49 |
| (F) 0.05% Product A (1.00 gm/2000 ml) & 100 ppm Texaco NPE 9.5 P05 (0.20 gm/2000 ml) & 80 ppm Avail. Chlorine (1.60 gm 10.01% active XY-12/2000 ml) | 9.74 | 9.71 |
| (G) 0.04% Product B without enzyme (0.80 gm/2000 ml) or 1 oz./19.5 gal. | 8.50 | — |
| (H) 25 ppm Esperase 8.0 L (0.050 gm/2000 ml) | 8.00 | — |
| (I) 0.04% Product B with Esperase 8.0 L (0.80 gm/2000 ml) or 1 oz./19.5 gal. | 7.83 | — |
| (J) 25 ppm Esperase 8.0L (0.50 gm/2000 ml) & 0.05% Product A (1.00 gm/2000 ml). | 9.58 | — |
| (K) 0.05% Product A (1.00 gm/2000 ml) & 0.04% Product B with Esperase 8.0 L (0.80 gm/2000 ml) | 9.49 | — |

3) 1000 ml of desired cleaning solution plus 0.25% (2.5 ml/1000 ml) milk soil when required, was placed in 1000 ml beaker. The solution was then heated to desired temperature and one soiled panel was placed in bottom of beaker. The solution was agitated for 15 min. while maintaining temperature by means of a magnetic stir bar and magnetic, heating, stir plate.
4) After cleaning, the panels were rinsed with DI water and allowed to air dry.
5) Cleaning was measured by means of the HunterLab UltraScan Spectrophotometer Model US-8000.
6) Settings on the instrument were RSEX\UVL ON\UVF OUT\LAV.
7) The percent change (cleaning) was calculated by the formula WI (panel after cleaning)-WI (panel after soiling) /WI (panel after soiling)×100.WI=Whiteness Index.

This series of tables contains the majority of laboratory evidence proving our claims that:

Table A

Alkaline protease acting of and by itself, without cooperative effect of other detersive agents, removes adsorbed protein (film) from food soiled surfaces. This effect is shown on the chart of Protein Film Soil Removal, detersive solution A, 50° C. as compared to a built, high alkaline, chlorinated commercial CIP detergent-PRINCIPAL at 50° C. utilized at recommended use-dilutions. Also notable from FIG. 1, solution A-the enzyme, Purafect®4000L, does not perform well on protein film by itself at 65° C.; whereas, if it is used with the stabilizing system, cleaning performance (protein soil removal) is dramatically improved (see FIG. 1 for solution C) even at 65° C. thus showing unexpected cooperative effect at use dilution. Prior art teaches the stabilizing effect of enzyme stabilizing systems within the composition concentration (i.e. shelf-life)—nothing is discussed or disclosed pertaining to effect at product use dilution. Also notable from comparison of FIG. 1-solution A used at 65° C. (FIG. 1) to PRINCIPAL (FIG. 1) is that at 65° C. PRINCIPAL performs much better on protein soil than at 50° C.; and, this is because of an apparent energy of activation threshold for chlorine discovered during the course of these experiments. In effect, this discovery seems to indicate that low temperature CIP cleaning can never be achieved using the standard high alkaline, chlorinated products now utilized in the food process industry; whereas, the present invention is ideally suited for low temperature CIP applications. Solution H, FIG. 2 containing Esperase®8.0L (an alkaline protease having greater high temperature tolerance) confirms that this enzyme has higher activity in higher temperature detersive solutions than Purafect®4000L. The observations illustrated in FIGS. 1 and 2 are again repeated in these experiments. Noted from both FIGS. 1 and 2 (one for Purafect® solutions, one for Esperase® solutions) is that the dual product enzyme/builder system is far superior to PRINCIPAL; that there is a cooperative effect by combining the two solutions; and, that the dual component performance solution K is superior to solution F which contains the builder/surfactant (without enzyme) and 80 ppm chlorine (FIG. 2). Disclosed in the table A is evidence that enzyme containing systems are not affected by presence of milk soil; whereas, chlorine containing systems are very significantly affected (manifested by reduced protein film removal).

TABLE B

| TEST SET | SS PANEL | CLEANING SOLUTION | CLEANING TEMPERATURE | CLEANING TIME | WHOLE MILK SOIL | WI (After Soiling) | WI (After Cleaning) | PERCENT CLEANING |
|---|---|---|---|---|---|---|---|---|
| I | (21) | NaOH 500 ppm | 50° C. | 60 min. | — | 16.28 | 18.29 | 12.35 |
| | (22) | NaOH 1000 ppm | 50° C. | 60 min. | — | 16.62 | 18.97 | 14.14 |
| | (23) | NaOH 2000 ppm | 50° C. | 60 min. | — | 16.04 | 19.18 | 19.58 |
| | (24) | NaOH 2000 ppm | 50° C. | 60 min. | — | 15.38 | 22.50 | 46.29 |
| | (25) | NaOH 20000 ppm | 50° C. | 60 min. | — | 17.10 | 24.67 | 44.27 |
| II | (21) | (L) | 50° C. | 30 min. | — | 20.05 | 23.42 | 16.81 |
| | (22) | (L) + NaOH 500 ppm | 50° C. | 30 min. | — | 20.17 | 24.68 | 22.36 |
| | (23) | (L) + NaOH 1000 ppm | 50° C. | 30 min. | — | 20.36 | 25.22 | 23.87 |
| | (24) | (L) + NaOH 10000 ppm | 50° C. | 30 min. | — | 12.90 | 19.90 | 54.26 |
| II | (25) | (L) + NaOH 20000 ppm | 50° C. | 30 min. | — | 18.43 | 38.52 | 109.00 |
| III | (16) | (M) | 50° C. | 60 min. | — | 17.17 | 20.89 | 21.67 |
| I | (21) | NaOH 500 ppm | 50° C. | 60 min. | — | 16.28 | 18.29 | 12.35 |
| IV | (29) | (M) + NaOCl 80 ppm | 50° C. | 15 min. | — | 18.31 | 23.84 | 30.20 |
| | (27) | (M) + NaOCl 80 ppm | 50° C. | 30 min. | — | 18.30 | 32.34 | 76.72 |
| | (28) | (M) + NaOCl 80 ppm | 50° C. | 60 min. | — | 16.57 | 39.73 | 139.77 |
| V | (31) | (M) + Esperase 8.0L ® 100 ppm | 50° C. | 15 min. | — | 16.97 | 41.20 | 142.78 |
| | (30) | (M) + Esperase 8.0L ® 100 ppm | 50° C. | 30 min. | — | 16.10 | 41.40 | 157.14 |
| I | (21) | NaOH 500 ppm | 50° C. | 60 min. | — | 16.28 | 18.29 | 12.35 |
| V | (18) | (M) + Esperase 8.0L ® 100 ppm | 50° C. | 60 min. | — | 11.43 | 41.94 | 266.93 |
| VI | (37) | (M) + Esperase 8.0L ® 10 ppm | 50° C. | 30 min. | — | 24.14 | 41.79 | 73.12 |
| | (36) | (M) + Esperase 8.0L ® 25 ppm | 50° C. | 30 min. | — | 23.00 | 41.59 | 80.83 |

TABLE B-continued

| TEST SET | SS PANEL | CLEANING SOLUTION | CLEANING TEMPERATURE | CLEANING TIME | WHOLE MILK SOIL | WI (After Soiling) | WI (After Cleaning) | PERCENT CLEANING |
|---|---|---|---|---|---|---|---|---|
| | (25) | (M) + Esperase 8.0L ® 50 ppm | 50° C. | 30 min. | — | 18.43 | 38.52 | 109.00 |
| VII* | (38) | (M) + Esperase 8.0L ® 100 ppm | 50° C. | 0–30 min. | — | 22.01 | 41.69 | 89.41 |
| | (39) | (M) + Esperase 8.0L ® 100 ppm | 50° C. | 60–90 min. | — | 21.64 | 42.51 | 96.44 |
| VII* | (40) | (M) + Esperase 8.0L ® 100 ppm | 50° C. | 120–150 min. | — | 20.71 | 40.70 | 92.29 |
| | (41) | (M) + Esperase 8.0L ® 100 ppm | 50° C. | 180–210 min. | — | 21.66 | 40.68 | 87.81 |
| I | (21) | NaOH 500 ppm | 50° C. | 60 min. | — | 16.28 | 18.29 | 12.35 |
| | (42) | (M) Esperase 8.0L ® 100 ppm | 50° C. | 240–270 min. | — | 19.87 | 41.46 | 108.66 |
| | (43) | (M) + Esperase 8.0L ® 100 ppm | 50° C. | 300–330 min. | — | 17.75 | 39.66 | 123.44 |
| VIII | (33) | (M) + Esperase 8.0L ® 100 ppm | 50° C. | 30 min. | 1.00% | 11.59 | 37.20 | 220.97 |
| I | (21) | NaOH 500 ppm | 50° C. | 60 min. | — | 16.28 | 18.29 | 12.35 |
| VIII | (34) | (M) + Esperase 8.0L ® 100 ppm | 50° C. | 30 min. | 0.10% | 15.68 | 39.45 | 151.59 |
| | (35) | (M) + NaOCl 100 ppm | 50° C. | 30 min. | 1.00% | 16.81 | 18.93 | 12.61 |
| | (19) | (M) + NaOCl 100 ppm | 50° C. | 30 min. | 0.10% | 21.57 | 30.81 | 42.84 |

*(M) + Esperase ® 8.0L 100 ppm solutions held with agitation for 5.5 hours at 50° C.
At time 0, 1, 2, 3, 4, 5 hours, a soiled SS panel was added to agitated solution for 30 minute increments, then removed.

CLEANING OF SOILED SS PANELS

Comparison of high alkaline detergent solutions without chlorine versus low alkaline detergent solutions containing chlorine or containing proteolytic enzyme.

1) The Stainless Steel 304 panels used in this cleaning evaluation were prepared/soiled according to Ecolab RB No. 9419-3,4 "Procedure for Protein Soiling and Cleaning of Stainless Steel Panels" (See page 96, line 9 through page 99, line 5).
2) The following cleaning solutions were prepared in 60 ppm City water.
   (L) PRINCIPAL without chlorine, 4000 ppm solution. PRINCIPAL is a commercial, conventional, chlorinated, high alkaline, CIP detergent manufactured by Ecolab Inc.
   (M) A low alkaline, non-chlorinated solution consisting of 1000 ppm sodium tripoly[phosphate, 500 ppm sodium bicarbonate, and 500 ppm sodium carbonate.
3) 1000 ml of desired cleaning solution plus milk soil when required, was placed in 1000 ml beaker. The solution was then heated to desired temp. and one soiled panel was placed in bottom of beaker. The solution was agitated for 15 min. while maintaining temperature by means of a magnetic stir bar and magnetic, heating, stir plate.
4) After cleaning, the panels were rinsed with DI water and allowed to air dry.
5) Cleaning was measured by means of the HunterLab UltraScan Spectrophotometer Model US-8000.
6) Settings on the instrument were RSEX\UVL ON/UVF OUT/LAV.
7) The percent change (cleaning) was calculated by the formula WI (panel after cleaning)-WI (panel after soiling) /WI (panel after soiling)×100. WI=Whiteness Index.

Table B contains several experiment "sets" which add additional detail to this invention:

Set I shows that solutions of caustic, even up to 2% solutions, have limited effect upon protein soil removal (as compared to enzyme systems shown in sets V to VIII). Set II is simply PRINCIPAL without chlorine. Set III is a set of solutions combining the water conditions agents in PRINCIPAL with the same levels of caustic utilized in Set I. Set III is a low alkaline, phosphate containing detergent with carbonate builder which was utilized in early experiments with enzyme. Sets IV to VIII are experiments utilizing this low alkaline detergent (Solution M) with varying levels of Esperase®8.0L and differing cleaning times (all temperatures are at 50° C.). Set VII is of particular interest because these experiments would indicate that Esperase®8.0L remains active for extended periods of time—a critical need in reuse CIP systems wherein the cleaning solution is reused again and again for several hours.

TABLE C

| TEST SET | CLEANING SOLUTION | CLEANING TEMPERATURE | CLEANING TIME | * pH | WI (After Soiling) | WI (After Cleaning) | PERCENT CLEANING |
|---|---|---|---|---|---|---|---|
| I | (M) + Esperase ® 8.0L 50 ppm | 50° C. | 30 min. | 8.3 | 22.16 | 42.90 | 93.59 |
| II | (M) + Esperase ® 8.0L 10 ppm | 50° C. | 30 min. | 10.3 | 21.17 | 41.67 | 96.84 |
| | (M) + Esperase ® 8.0L 25 ppm | 50° C. | 30 min. | 10.3 | 16.50 | 37.41 | 126.73 |
| III | (M) + Esperase ® 8.0L 50 ppm | 50° C. | 30 min. | 8.3 | 16.00 | 40.02 | 150.13 |
| | (M) + Esperase ® 8.0L 50 ppm | 50° C. | 30 min. | 9.3 | 17.96 | 39.35 | 119.10 |
| | (M) + Esperase ® 8.0L 50 ppm | 50° C. | 30 min. | 10.3 | 17.54 | 41.37 | 135.86 |
| | (M) + Esperase ® 8.0L 50 ppm | 50° C. | 30 min. | 11.3 | 18.68 | 40.33 | 126.61 |
| IV | (M) + Esperase ® 8.0L 50 ppm | 50° C. | 5 min. | 10.3 | 16.27 | 36.70 | 125.57 |
| | (M) + Esperase ® 8.0L 50 ppm | 50° C. | 10 min. | 10.3 | 16.44 | 39.02 | 137.35 |
| | (M) + Esperase ® 8.0L 50 ppm | 50° C. | 15 min. | 10.3 | 17.03 | 40.69 | 138.93 |
| | (M) + Esperase ® 8.0L 10 ppm | 50° C. | 30 min. | 10.3 | 19.39 | 41.42 | 113.62 |

*Normal pH of (M) solution is about 10.3. Other test pH solutions adjusted with $H_3PO_4$ or NaOH.

CLEANING OF SOILED SS PANELS

Esperase® 8.0L cleaning performance as a function of detersive solution pH or soil contact time.

1) The Stainless Steel 304 panels used in this cleaning evaluation were prepared/soiled according to Ecolab RB No. 9419-3,4 "Procedure for Protein Soiling and Cleaning of Stainless Steel Panels" (See page 96, line 9 through page 99, line 5).
2) The following cleaning solutions were prepared in 60 ppm City water.
   (M) A low alkaline, non-chlorinated solution consisting of 1000 ppm sodium tripolyphosphate, 500 ppm sodium bicarbonate, and 500 ppm sodium carbonate.
3) 1000 ml of desired cleaning solution plus milk soil when required, was placed in 1000 ml beaker. The solution was then heated to desired temperature and one soiled panel was placed in bottom of beaker. The solution was agitated for 15 min. while maintaining temperature by means of a magnetic stir bar and magnetic, heating, stir plate.
4) After cleaning, the panels were rinsed with DI water and allowed to air dry.
5) Cleaning was measured by means of the HunterLab UltraScan Spectrophotometer Model US-8000.
6) Settings on the instrument were RSEX/UVL ON/UVF OUT/LAV.
7) The percent change (cleaning) was calculated by the formula WI (panel after cleaning)-WI (panel after soiling) /WI (panel after soiling)×100. WI=Whiteness Index.

Table C having Sets I to IV illustrates cleaning performance of solution M with varying levels of Esperase® 8.0L at different solution pH's and with different cleaning exposure times. This data is useful in selection of detergent enzyme levels, CIP program soil contact (wash) times; and, also effect of lower pH's on detersive solutions (as might be encountered in heavily soiled operations containing acid foodstuffs).

TABLE D

| TEST SET | CLEANING SOLUTION | CLEANING TEMPERATURE | CLEANING TIME | WI (After Soiling) | WI (After Cleaning) | PERCENT CLEANING |
|---|---|---|---|---|---|---|
| I | PRINCIPAL | 50° C. | 5 min. | 7.65 | 10.00 | 30.72 |
| | PRINCIPAL | 50° C. | 10 min. | 11.54 | 15.55 | 34.75 |
| | PRINCIPAL | 50° C. | 15 min. | 9.63 | 17.40 | 80.69 |
| | PRINCIPAL | 65° C. | 5 min. | 10.81 | 21.90 | 102.59 |
| | PRINCIPAL | 65° C. | 10 min. | 10.96 | 37.37 | 240.97 |
| | PRINCIPAL | 65° C. | 15 min. | 13.91 | 37.95 | 172.83 |
| II | ULTRA[4] | 50° C. | 5 min. | 10.98 | 17.86 | 62.66 |
| | ULTRA | 50° C. | 10 min. | 11.63 | 13.35 | 14.79 |
| | ULTRA | 50° C. | 15 min. | 11.70 | 14.64 | 25.13 |
| | ULTRA | 65° C. | 5 min. | 11.63 | 12.92 | 11.09 |
| | ULTRA | 65° C. | 10 min. | 11.76 | 33.46 | 184.52 |
| | ULTRA | 65° C. | 15 min. | 12.08 | 38.29 | 216.97 |
| III | (M) + Esperase ® 8.0L 50 ppm | 50° C. | 10 min. | 10.86 | 38.37 | 253.31 |

[4]ULTRA is an ECOLAB commercial CIP detergent for use in industrial food processing - generally used at 1 oz./gal. dilution-containing potash (active $K_2O$ 7.4%) hypochlorite (CaO 100 ppm at dilute strength) and phosphate for controlling water hardness up to 12 grains per gallon.

CLEANING OF SOILED SS PANELS

Comparison of high alkaline, commercial CIP detersive solutions containing chlorine versus low alkaline, detersive solutions containing proteolytic enzyme.

M containing Esperase® 8.0L is very conclusive evidence for the detersive effect of enzyme on protein film. This body of evidence strongly suggests an energy barrier for effective chlorine removal of protein film.

TABLE E

| | | | | Non-Chlorine Exposed Panels | | | Low-Chlorine Exposed Panels | | |
|---|---|---|---|---|---|---|---|---|---|
| TEST SET | CLEANING SOLUTION | CLEANING TEMPERATURE | CLEANING TIME | WI (After Soiling) | WI (After Cleaning) | PERCENT CLEANING | WI (After Soiling) | WI (After Cleaning) | PERCENT CLEANING |
| 5 | NaOH 2000 ppm | 50° C. | 30 min. | — | — | — | 12.25 | 10.09 | −17.63 |
| | NaOH 2000 ppm | 50° C. | 30 min. | — | — | — | 4.80 | 4.25 | −11.46 |
| | NaOH 2000 ppm | 65° C. | 30 min. | — | — | — | 7.16 | 7.21 | 0.70 |
| | NaOH 2000 ppm | 50° C. | 60 min. | 16.04 | 19.18 | 19.58 | — | — | — |
| | NaOH 1000 ppm | 50° C. | 60 min. | 16.62 | 18.97 | 14.14 | — | — | — |
| 10 | NaOH 2000 ppm + NaOCl 100 ppm | 50° C. | 30 min. | — | — | — | 8.86 | 18.50 | 108.80 |
| | NaOH 2000 ppm + NaOCl 100 ppm | 65° C. | 30 min. | — | — | — | 5.41 | 41.89 | 674.31 |
| II | (M) | 50° C. | 30 min. | — | — | — | 5.71 | 15.19 | 166.02 |
| | (M) | 50° C. | 60 min. | 17.17 | 20.89 | 21.67 | — | — | — |
| III | (M) + Esperase ® 8.0L 50 ppm | 50° C. | 30 min. | 12.83 | 39.85 | 210.60 | — | — | — |
| 15 | (M) + Esperase ® 8.0L 50 ppm | 50° C. | 30 min. | — | — | — | 4.96 | 18.18 | 266.53 |
| IV | (N) | 50° C. | 30 min. | 18.50 | 28.65 | 54.65 | — | — | — |
| | (N) | 50° C. | 30 min. | — | — | — | 5.34 | 17.60 | 229.59 |
| V | (O) | 50° C. | 30 min. | 15.63 | 40.91 | 161.74 | — | — | — |
| | (O) | 50° C. | 30 min. | — | — | — | 4.18 | 21.96 | 425.36 |

*The "Procedure for Protein Soiling and Cleaning of Stainless Steel Panels" described in this invention normally employs Principal without chlorine. For these test panels only, 25 ppm NaOCl was added with Principal to develop chloro-protein films on the panel surfaces.

1) The Stainless Steel 304 panels used in this cleaning evaluation were prepared/soiled according to Ecolab RB No. 9419-3,4 "Procedure for Protein Soiling and Cleaning of Stainless Steel Panels" (See page 96, line 9 through page 99, line 5).
2) The following cleaning solutions were prepared in 60 ppm City water:
   4000 ppm PRINCIPAL with about 100 ppm chlorine. PRINCIPAL is a commercial, conventional, chlorinated, high alkaline CIP detergent manufactured by Ecolab Inc. 4000 ppm ULTRA with about 100 ppm chlorine. ULTRA is a commercial, conventional, chlorinated, high alkaline CIP detergent which contains phosphates and silicates manufactured by Ecolab Inc.
   (M) A low alkaline, non-chlorinated solution consisting of 1000 ppm sodium tripolyphosphate, 500 ppm sodium bicarbonate, and 500 ppm sodium carbonate.
3) 1000 ml of desired cleaning solution plus milk soil when required, was placed in 1000 ml beaker. The solution was then heated to desired temperature and one soiled panel was placed in bottom of beaker. The solution was agitated for 15 min. while maintaining temperature by means of a magnetic stir bar and magnetic, heating, stir plate.
4) After cleaning, the panels were rinsed with DI water and allowed to air dry.
5) Cleaning was measured by means of the HunterLab UltraScan Spectrophotometer Model US-8000.
6) Settings on the instrument were RSEX/UVL ON/UVF OUT/LAV.
7) The percent change (cleaning) was calculated by the formula WI (panel after cleaning)-WI (panel after soiling) /WI (panel after soiling)×100. WI=Whiteness Index.

Table D containing protein film removal performance of PRINCIPAL[5] and ULTRA and the comparison with solution

CLEANING OF SOILED SS PANELS

Comparison of high alkaline detersive solutions with and without chlorine versus low alkaline detersive solutions containing proteolytic enzyme on chloro-protein films.

1) The Stainless Steel 304 panels used in this cleaning evaluation were prepared/soiled according to Ecolab RB No. 9419-3,4 "Procedure for Protein Soiling and Cleaning of Stainless Steel Panels" (See page 96, line 9 through page 99, line 5).
2) The following cleaning solutions were prepared in 60 ppm City water:
   (M) A low alkaline, non-chlorinated solution consisting of 1000 ppm sodium tripolyphosphate, 500 ppm sodium bicarbonate, and 500 ppm sodium carbonate.
   (N) Soln (M)+200 ppm Triton CF-21. Triton®CF-21 is a commercial, octyl phenol ethoxylate propoxylate manufactured by BASF Corp.
   (O) Soln (M)+200 ppm Triton®CF-21+100 ppm Esperase® 8.0L.
3) 1000 ml of desired cleaning solution plus milk soil when required, was placed in 1000 ml beaker. The solution was then heated to desired temperature and one soiled panel was placed in bottom of beaker. The solution was agitated for 15 min. while maintaining temperature by means of a magnetic stir bar and magnetic, heating, stir plate.
4) After cleaning, the panels were rinsed with DI water and allowed to air dry.
5) Cleaning was measured by means of the HunterLab UltraScan Spectrophotometer Model US-8000.
6) Settings on the instrument were RSEX/UVL ON/UVF OUT/LAV.
7) The percent change (cleaning) was calculated by the formula WI (panel after cleaning)-WI (panel after soiling) /WI (panel after soiling)×100. WI=Whiteness Index.

Table E makes comparisons of "non-chlorine" exposed panels to "low-chlorine" exposed panels and establishes another point of differentiation between enzyme containing compositions and the high alkaline, chlorine containing detergents now prevalent in the food processing industry. We have found, in general, that chloro-protein films are more difficult to remove once formed than protein films. Chloro-protein films are caused by the use of chlorine in detergents at low levels (or caused by high soil conditions which deactivate the majority of chlorine in solution). Set I confirms that high levels of caustic have no effect on removal of chloro-protein unless high levels of chlorine are also present. Although enzyme containing detergents would not contain chlorine in the formulation, hence would not form chloro-protein, evidence contained in Sets III and IV strongly suggest that enzyme detersive solutions do remove chloro-protein films if present on surfaces. This result is important from a logistics standpoint—when customers convert from the high alkaline, chlorinated detergents to the enzyme compositions of this invention, chloro-protein films may be the first protein films encountered on surfaces until removed completely from the CIP system.

WORKING EXAMPLE 35

Solid Block Enzyme Formulation (One Part Product)

| Solid Enzyme Premix: | (%) |
|---|---|
| 1. Sodium Tripoly-hexahydrate | 80.00 |
| 2. Purafect 4000-G, protease | 8.40 |
| 3. Sodium Carbonate, dense | 11.60 |
| | 100.00% |

1. Added items 1, 2 and 3. Mixed until thoroughly blended.

| Solid Enzyme: | (%) |
|---|---|
| 1. Soft Water | 28.48 |
| 2. Polyacrylate, bulk | 6.00 |
| 3. Sodium Hydroxide, 50% | 3.00 |
| 4. Sodium Carbonate, dense | 21.00 |
| 5. Texaco* NPE 9.5 PO5< | 10.00 |
| 6. Enzyme Premix | 30.0 |
| 7. Sodium Carbonate, dense | 1.52 |
| | 100.00% |

*Nonylphenolethoxylate having about 9.5 moles ethylene oxide and capped with about 5 moles propylene oxide.

1. Mixed items 1 and 2. Added enough caustic, item 3, to the solution to get pH 8.0–10.0.
2. Slowly added ash, item 4. Temperature rose. It is extremely important to keep batch temperature in a range between 95°–110° F. Cooled with ice.
3. Charged item 5, Texaco PNE 9.5, to the solution. Cooled the base solution to 90°–95° F.
4. Added Enzyme Premix slowly. Kept solution below 95° F.
5. Added ash, item 7, slowly. Mixed 5 minutes controlling temperature below 100° F.

Solid product was pourable and appeared homogeneous. Using U.S. Pat. No. 4,595,520 technology for product preparation—in 100 grams sample size temperature did not go above 95°–100° F. This method worked well for enzyme addition, no worry about adding enzyme above 125° F., which would de-activate the enzyme as could occur with the PEG type product process.

Prepared solid cooled to room temperature. Prepared solid formed a block.

WORKING EXAMPLE 36

Comparison of CIP Powdered Cleaner With and Without Enzyme

Stainless Steel Panel Cleaning Procedure:

Soiled stainless steel panel cleaning test was conducted using the Glewwe foam machine. The Glewwe foam machine provides control of water temperature and water pressure.

1. Installed the four jet spray CIP cleaning nozzle on the stainless steel tubing assembly of the Glewwe foam machine.
2. Prepared 3 liters of product to be tested at used dilution in specified hardness water. (well water, ~15 grains hardness) at 140° F. Placed product dilution in the plastic cylinder—stainless steel beaker assembly of the Glewwe foam machine.
3. Started the Glewwe foam machine pump and adjusted water pressure to 3 psi.
4. With pump running, adjusted water temperature, if necessary. If extra product dilution was present, stopped pump and drained to the 3 liter mark on the stainless steel beaker using the drain valve.
5. Hung the prepared "soiled" panel to the inside of the Glewwe foam machine making sure the panel placement was centered with one of the four spray jets.
6. Turned Glewwe foam machine on spraying the product dilution onto the "soiled" panel for 8 minutes at 3 psi.
7. Removed panel from inside Glewwe foam machine and rinse with Dl water to remove cleaning solution. Hung panel to air dry for 30 minutes prior to PROTEIN STAINING PROCEDURE.

Protein Staining Procedure:

The following solutions were prepared prior to conducting protein staining procedure:

Solution:

| | |
|---|---|
| A. Staining Solution | |
| 1. 50% MeOH(D1 water) | 454 mls |
| 2. Glacial Acetic Acid | 46 mls |
| 3. Coomasie Brilliant Blue R Dye | 1.25 gms |
| B. Destaining Solution | |
| 1. Methanol | 50 mls |
| 2. Glacial Acetic Acid | 75 mls |
| 3. D1 water | 875 mls |

1. Dipped the air dried panel from above in the staining solution.
2. Using a disposable pipet, rinsed surface of the stained panel with destaining solution. If protein was present, the dye adhered to it instantaneously.
3. If a protein film existed on the surface, a definite, although perhaps faint, blue film remained.

Results:

Formula #1

Chlorine-Free CIP Alkaline Cleaner w/o Enzyme (1 ounce/8 gallons )

Less than 10% soiled removed

Formula #2

Chlorine-Free CIP Alkaline Cleaner w/Enzyme (1 ounce/8 gallons)

99% soil removed. (Less than 1% soil remained).

Water Control

Less than 5% soil removed.

| | | |
|---|---|---|
| 1. Sodium Carbonate, dense | 58.50% | 60.00% |
| 2. Sodium Tripolyphosphate | 25.00% | 25.00% |
| 3. Sodium Metabisulfite | 0.00% | 0.50% |
| 4. Surfonic LF-41 | 10.00% | 6.00% |
| 5. Purafect 4000G, protease | — | 2.50% |
| 6. Goodrite K-7058D, polyacrylate | 6.00% | 6.00% |
| | 100.00% | 100.00% |

The above specification, examples and data provide a complete description of the manufacture and use of the composition of the invention. Since many embodiments of the invention can be made without departing from the spirit and scope of the invention, the invention resides in the claims hereinafter appended.

We claim:

1. An enzyme-containing detergent composition for cleaning regimens in food process industries comprising in a solid block form and free of an alkaline metal hydroxide and a source of active chlorine, the composition comprising a solid block composition with an effective amount of enzyme blended throughout the solid block, the solid comprising:

(a) an effective amount of a proteolytic enzyme or enzyme mixture;

(b) a low alkaline builder or builder mixture;

(c) a water conditioning agent or mixture;

(d) a surfactant selected from the group consisting of: $R\text{-}(EO)_e\text{-}(PO)_pH$; $R\text{-}(EO)_e\text{-}(BuO)_bH$; $R\text{-}(EO)_e\text{-}R^1$; $R\text{-}(PO)_p\text{-}(EO)_eH$; $R\text{-}(PO)_p\text{-}(EO)_e\text{-}(PO)_pH$; $R\text{-}(PO)_p\text{-}(EO)_e$-benzyl; $(PO)_p\text{-}(EO)_e\text{-}(PO)_p$; $\{(PO)_p\text{-}(EO)_e\text{-}\}_2\text{—}NCH_2CH_2N\text{—}\{(EO)_e\text{-}(PO)_p\}_2$; and mixtures thereof;

wherein R is a $C_{6\text{-}18}$alkyl group, a $C_{6\text{-}18}$ alkyl or dialkyl phenol group, or a $C_{6\text{-}18}$alkyl-$(PO)_p$- group; $R^1$ is a $C_{1\text{-}8}$alkyl; each e is independently about 1–20, each p is independently about 1–20, and each b is independently about 1–10; (e) a solidifier and (f) water;

which when diluted in water provides a clean-in-place use-solution comprising:

($a^1$) the enzyme or enzyme mixture having an activity from about $1\times10^{-5}$ KNPU/gm solution to about $4\times10^{-3}$ KNPU/gm solution;

($b^1$) from about 25 ppm to about 1000 ppm of said builder or builder mixture;

($c^1$) from about 5 ppm to about 400 ppm of the water conditioning agent or mixture; and ($d^1$) from about 20 ppm to about 1000 ppm of said surfactant.

2. The composition of claim 1 wherein the solid block detergent comprises a compressed solid block.

3. The composition of claim 1 wherein e is about 6–18, p is about 3–10, and b is about 1–5.

4. The composition of claim 1 wherein the solid block is packaged in a disposable container.

5. The composition of claim 1 wherein the water conditioning agent is selected from the group consisting of a polyacrylic acid polymer, a sodium or potassium condensed phosphate, ethylene diamine tetraacetate alkali metal salt, and mixtures thereof.

6. The composition of claim 5 wherein the water conditioning agent is selected from the group consisting of a polyacrylic acid polymer, a sodium or potassium condensed phosphate, and a mixture thereof.

7. The composition of claim 1 wherein the low alkaline builder is selected from the group consisting of a silicate, a carbonate, or mixtures thereof.

8. The composition of claim 1, wherein the enzyme or enzyme mixture comprises an encapsulated enzyme.

9. The composition of claim 1 wherein the enzyme comprises a lipase, an amylase or mixtures thereof.

10. An enzyme-containing detergent composition for cleaning regimens in food process industries comprising in a solid block form and free of an alkaline metal hydroxide and a source of active chlorine, the composition comprising a solid block composition with an effective amount enzyme blended throughout the solid block, the solid comprising:

(a) an effective amount of a proteolytic enzyme or enzyme mixture;

(b) a low alkaline builder or builder mixture;

(c) a water conditioning agent or mixture;

(d) a surfactant selected from the group consisting of: $R\text{-}(EO)_e\text{-}(PO)_pH$; $R\text{-}(EO)_e\text{-}(BuO)_bH$; $R\text{-}(EO)_e\text{-}R^1$; $R\text{-}(PO)_p\text{-}(EO)_eH$; $R\text{-}(PO)_p\text{-}(EO)_e\text{-}(PO)_pH$; $R\text{-}(PO)_p\text{-}(EO)_e$-benzyl; $(PO)_p\text{-}(EO)_e\text{-}(PO)_p$; $\{(PO)_p\text{-}(EO)_e\text{-}\}_2\text{—}NCH_2CH_2N\text{—}\{(EO)_e\text{-}(PO)_p\}_2$; and mixtures thereof;

wherein R is a $C_{6\text{-}18}$alkyl group, a $C_{6\text{-}18}$alkyl or dialkyl phenol group, or a $C_{6\text{-}18}$alkyl-$(PO)_p$- group; $R^1$ is a $C_{1\text{-}8}$alkyl; each e is independently about 1–20, each p is independently about 1–20, and each b is independently about 1–10; and (e) a solidifier; and (f) water which when diluted with water provides a clean-in-place use solution comprising the enzyme or enzyme mixture having an activity from about $1\times10^{-5}$ KNPU/gm solution to about $4\times10^{-3}$ KNPU/gm solution.

11. The composition of claim 10 wherein the solidifier is polyethylene glycol or polypropylene glycol having a molecular weight of from about 1400 to about 30,000.

* * * * *

UNITED STATES PATENT AND TRADEMARK OFFICE

CERTIFICATE OF CORRECTION

PATENT NO. : 5,861,366

DATED : JANUARY 19, 1999

INVENTOR(S) : IHNS ET AL.

It is certified that error appears in the above-identified patent and that said Letters Patent is hereby corrected as shown below:

Col. 27, line 18: " $\rightleftharpoons\left[RNH\left(CH^{2}\right)_{n}CO_{2}^{-}\right]M^{+3}$" should read — $\rightleftharpoons\left[RNH\left(CH_{2}\right)_{n}CO_{2}^{-}\right]M^{+3}$ —

Col. 37, line 6: "$+CH_2$— $C+_x$" should read — $-[-CH_2-C-]_x-$ —

Signed and Sealed this

Twenty-fourth Day of October, 2000

*Attest:*

Q. TODD DICKINSON

*Attesting Officer*

*Director of Patents and Trademarks*